United States Patent [19]

Dickinson et al.

[11] Patent Number: 5,058,893

[45] **Date of Patent: * Oct. 22, 1991**

[54] REEL MONITORING DEVICE FOR AN AMUSEMENT MACHINE

[75] Inventors: Peter D. Dickinson; William K. Bertram, both of Reno, Nev.

[73] Assignee: IGT, Reno, Nev.

[ * ] Notice: The portion of the term of this patent subsequent to Mar. 27, 2007 has been disclaimed.

[21] Appl. No.: 497,059

[22] Filed: Mar. 21, 1990

Related U.S. Application Data

[63] Continuation of Ser. No. 688,295, Jan. 2, 1985, Pat. No. 4,911,449.

[51] Int. Cl.[5] ..... A63F 5/04

[52] U.S. Cl. ..... 273/143 R

[58] Field of Search ..... 273/138 A, 143 R, 138 R; 364/410, 411, 412

[56] References Cited

U.S. PATENT DOCUMENTS

| | | | |
|---|---|---|---|
| 3,606,337 | 9/1971 | Larsen | 273/143 |
| 4,074,258 | 2/1978 | Dore | 340/347 |
| 4,095,795 | 6/1978 | Saxton | 273/143 |
| 4,099,722 | 7/1978 | Rodesch | 273/143 |
| 4,238,127 | 12/1980 | Lucero | 273/143 |
| 4,262,906 | 4/1981 | Heywood | 273/143 |
| 4,396,193 | 8/1983 | Reinhardt | 273/142 |
| 4,421,310 | 12/1983 | Williams | 273/143 |
| 4,440,036 | 4/1984 | Hooker | 74/153 |

*Primary Examiner*—Edward M. Coven
*Assistant Examiner*—Jessica J. Harrison
*Attorney, Agent, or Firm*—Townsend and Townsend

[57] ABSTRACT

A slot machine is disclosed having three coaxially mounted reels and a mechanism for simultaneously spinning the three reels when a starting handle is pulled, and stopping them at three new stopping positions in response to control signals from a microprocessors. Each reel has a sprocket with 32 stopping positions and a coding ring with a plurality of slots arranged on a circumferential path about the reel's axis, forming a single track of digital information which may be read by a single optic sensor as the reel rotates. The track has 32 equally spaced fields of optical information corresponding to the 32 stopping positions of the reels. Each field has one slot, the slot width alternating between wide and narrow arcuate sizes about the coding ring, with one sequence of three narrow slots marking a home position for its respective reel.

After passage of the home position is detected, a reel position counter associated with each reel counts the number of fields that pass the reel's sensor to monitor the rotational position of that reel relative to a fixed reference point. Each time a new field is detected for a given reel, the microprocessor determines whether the rotational direction, speed, and acceleration or deceleration of that reel are correct based on the information from its track, and an appropriate error signal is issued if the reel is not spinning properly.

79 Claims, 14 Drawing Sheets

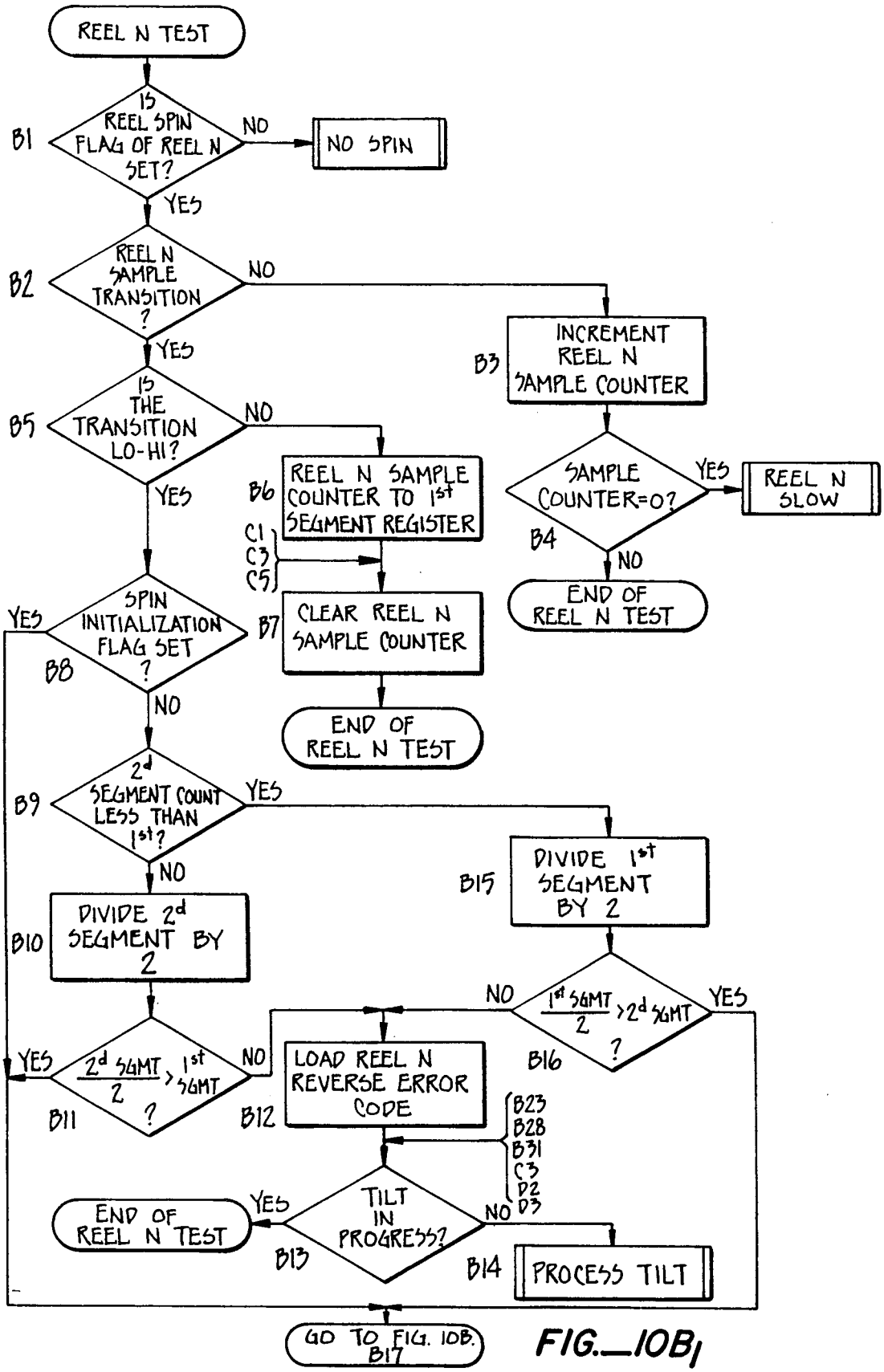
FIG._10B1

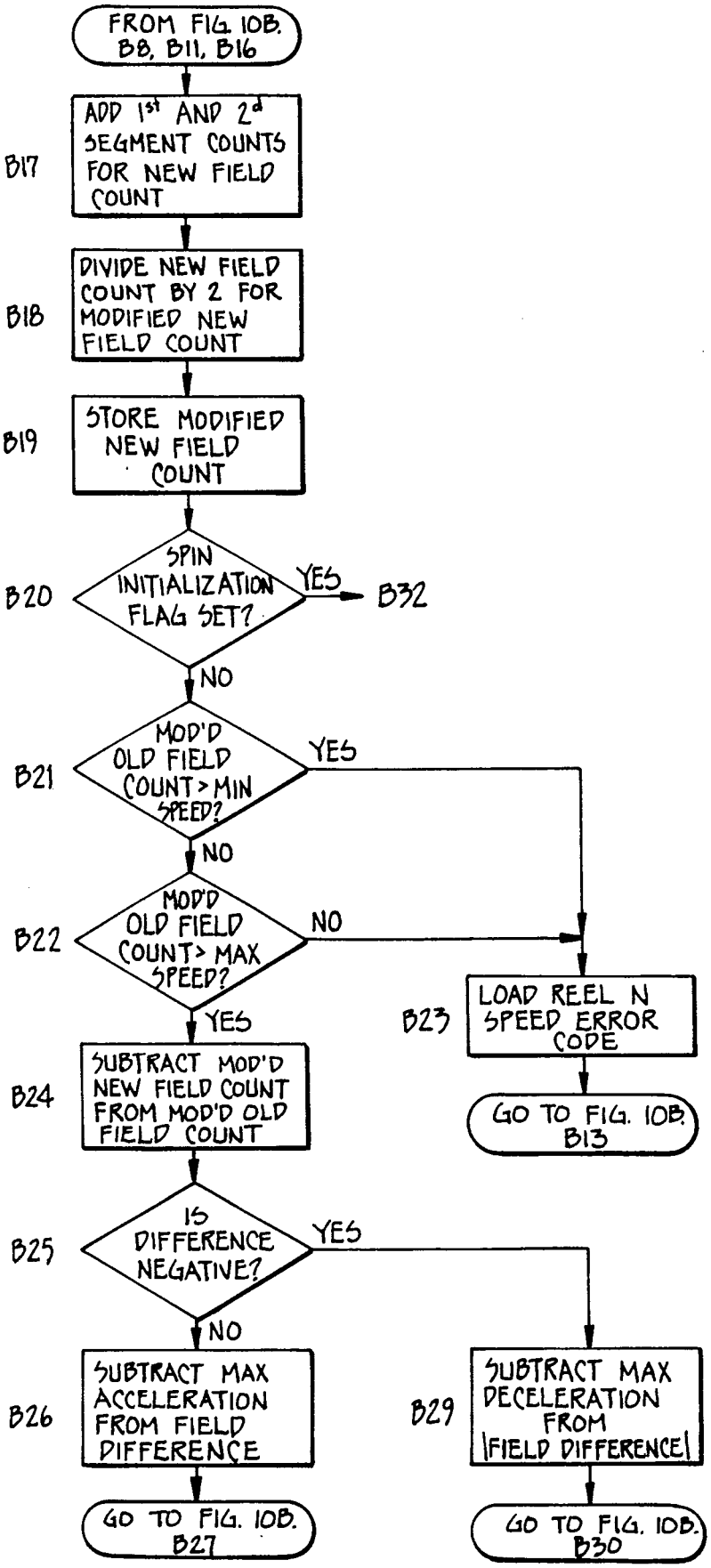
FIG._10B2

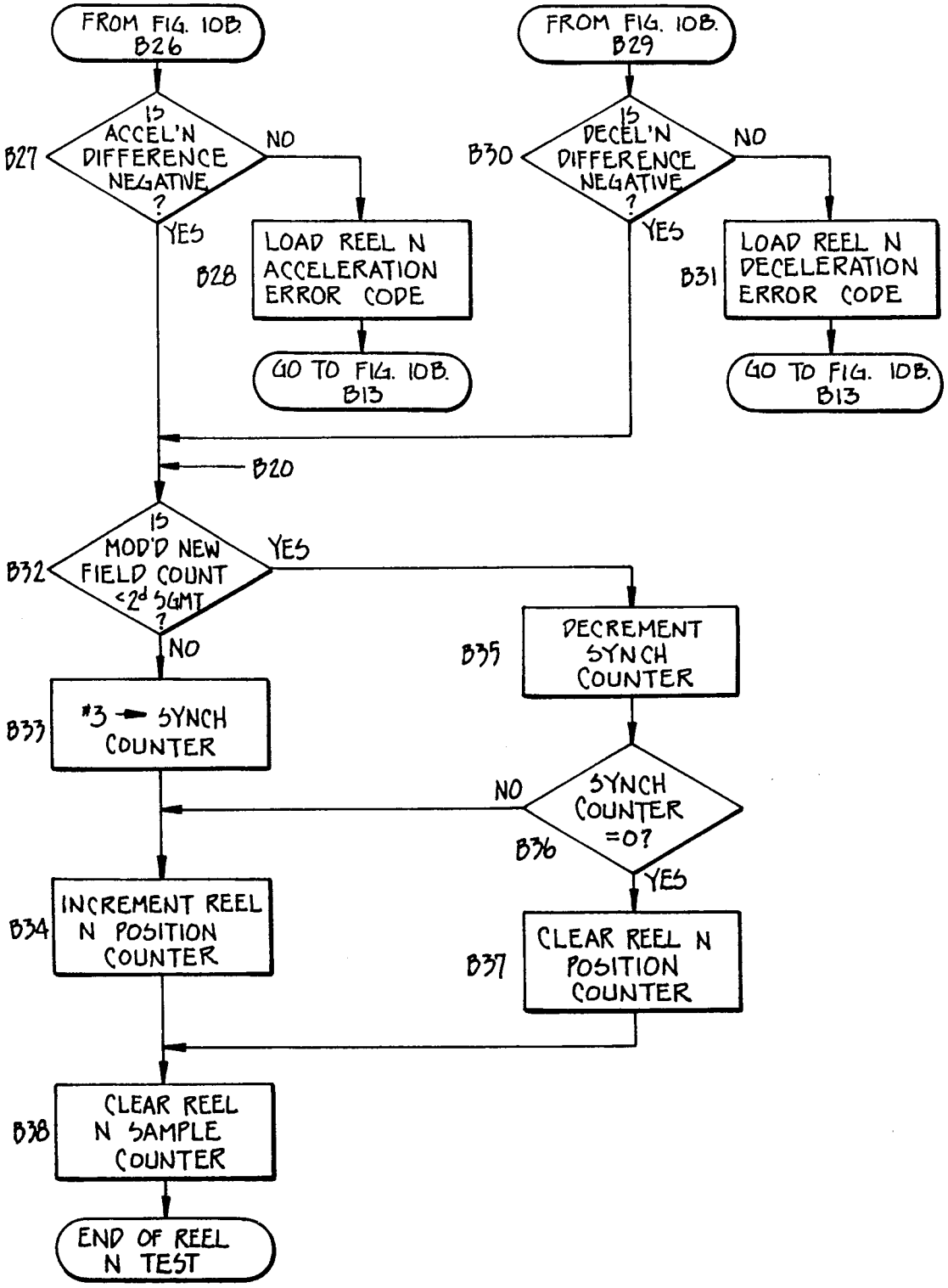
FIG._10B3

REEL MONITORING DEVICE FOR AN AMUSEMENT MACHINE

This document is submitted with a microfiche appendix, pursuant to 37 C.F.R. 1.96, consisting of 1 fiche having a total of 25 frames.

BACKGROUND OF THE INVENTION

The present invention relates generally to amusement machines having rotating reel assemblies, and to coin operated slot machines of the type found in Monte Carlo, Reno and other internationally known gaming resorts.

The steady rise in popularity of gaming resorts in recent decades has created a highly competitive atmosphere in the gambling industry, as resort owners vie for a larger piece of this growing market. In order to attract the greatest number of customers, one factor which is frequently exploited in the marketing plan of a contemporary gaming facility is the psychological attractiveness of a low probability, high payout option in slot machines. This option appeals to a segment of the market which is otherwise not inclined to gamble, but is intrigued by state lotteries and other low risk games which offer the possibility, however unlikely, of achieving instant wealth in return for a minimal wager. It is, therefore, not unusual to see slot machines in major resorts with potential cash jackpots in excess of $100,000 in return for as little as a $.25 bet.

Not surprisingly, legitimate gamblers are not the only ones who have been attracted by the possibility of instant wealth which these machines offer. The growth of jackpots has produced a highly competent and well-equipped cult of slot machine "pirates," whose techniques for tapping jackpots has advanced at a rate which nearly parallels the growing sophistication of slot machine technology. Accordingly, manufacturers of such machines have developed a variety of systems for verifying the accuracy of a reel spinning operation before issuing cash or credit based on the combination of reel positions resulting from that operation.

The most recent generation of error detection systems utilizes a microprocessor or equivalent circuitry to randomly generate one of a series of numbers for each reel which is being spun, each number of the series corresponding to one of the stopping positions of the reel. A plurality of reel sensors cooperates with a code on each reel to determine its instantaneous rotational position as it spins, and stop the reel when it reaches the stopping position designated by the random number. After the reel has stopped, the microprocessor determines whether the sensed reel position matches the random number, and issues an error signal if it does not. While these machines provide limited protection against tampering, their reel monitoring apparatus is unnecessarily complex and prone to failure, increasing manufacturing cost and down time. Furthermore, the error detection systems in such machines may be circumvented by professionals using state of the art equipment and techniques.

An example of such presently available slot machines may be seen in U.S. Pat. No. 4,421,310 to Williams, which discloses a reel monitoring apparatus utilizing two optic sensors for each reel to monitor the reel's rotational position and determine when its stopping solenoid should be fired. The alignment of these two sensors and maintenance of their mechanical and electrical integrity requires regular inspection and repair, resulting in an undesirable amount of machine down time. Other reel monitoring apparatus, as seen in U.S. Pat. No. 4,238,127 to Lucero, et al., provide five sensors for each reel, assigning a five bit digital code to each of thirty-two reel stopping positions so as to identify each position by a unique address. Such systems require a relatively high degree of maintenance, create complex data input and output requirements, and are generally expensive to design and manufacture due to the large number of parts, connections and processing steps needed to handle the multiplicity of control signals for each reel.

A further drawback to these machines results from their use of an error detection system which computes the intended stopping position of each reel at the start of a game, and then monitors the reel spinning operation to assure compliance with that computed position. Since it is known in advance where the reels of the machine will stop, it is possible to tap this source of data and change the intended stopping positions of the reels, so that the machines will think a legitimate jackpot has occurred when the reels stop at the altered stopping positions.

SUMMARY OF THE INVENTION

In accordance with a preferred, but nonetheless illustrative embodiment of the invention, a machine having spinning reels is provided which overcomes many of the disadvantages encountered with prior art machines of this type. In particular, the present invention provides a very simple sensing device which accurately monitors the instantaneous rotational position of a reel as it spins. By minimizing the number of elements involved in sensing reel rotation, the invention reduces manufacturing costs and minimizes machine down time resulting from repair and maintenance of complex sensing devices. The invention also provides for detection of improper reel movement as the reel is spinning, by analyzing various aspects of its rotation, such as speed, acceleration and direction of rotation, and determining whether, at any given point in time, these are within predefined operational parameters consistent with unhampered reel rotation. This not only serves to deter slot machine piracy, but may also aid in determining when and why the machine is not operating smoothly and alerting the owner of potential problems that may be avoided by timely maintenance. The invention also provides a novel apparatus for assuring that random reel spinning will occur without forecasting the intended reel stopping positions. This effectively deters those professionals who might otherwise access the memory registers in which the intended stopping positions are stored, and alter their contents to indicate a winning combination of numbers.

In one aspect of the present invention, the amusement machine comprises at least one reel mounted in a frame for rotation about an axis, having a plurality of indicia disposed thereabout. The reel has a single track positioned on a circumferential path about its axis for monitoring the rotational position of the reel relative to a fixed reference point. The track comprises a plurality of fields corresponding to the plurality of indicia, each field spanning a unique arcuate path at a fixed radial distance from the axis. A sensor is positioned so as to detect movement of the fields past a single point at the fixed radial distance, and a device responsive to the sensor is provided for detecting the passage of a home field. A reel position counter counts the number of fields that pass the sensor after the home field so as to permit the instantaneous rotational position of the reel to be monitored as it spins.

In the portions of the preferred embodiment corresponding to this aspect of the invention, the track is provided by a coding ring rotating with the reel, having a coded sequence of slots punched in it to indicate the rotational position of the reel. Each slot designates the start of a new field on the coding ring, and is associated with one of 32 teeth on a sprocket connected to the reel, thus defining one of 32 stopping positions. The slot width varies in accordance with a code which enables the rotational position of the reel to be determined by optically scanning a single point on the track as the reel rotates, thus providing effective reel position monitoring with a single reel sensor.

In another aspect of the invention, an amusement machine comprises a plurality of reels coaxially mounted in a frame for independent rotation, each having a plurality of indicia thereabout. Apparatus responsive to manual user input, such as pulling a handle on a pivoting lever, is provided for spinning the reels. A sensor is positioned adjacent each reel, the reel comprising a region of coded data circumferentially arranged about its axis. Each sensor cooperates with the coded data of its corresponding reel to output a different pattern of signals for each of a forward and reverse reel rotational direction, and an error signal is issued in response to one of these patterns. A reel stopping device independently stops the rotation of each reel in response to the output of its corresponding sensor. When the reels have stopped, the sequence of stopping positions is determined and assigned a predetermined game value. Apparatus is provided which issues a user perceivable indication of the assigned value, as by a visual display or output of a corresponding number of coins.

In the portions of the preferred embodiment corresponding to this aspect of the invention, the coded data is provided by a single track of wide and narrow slots in the above-mentioned coding ring. The track is composed of 32 fields of data, each field having either an "even" pattern of a wide slot followed by a narrow bar or an "odd" pattern of a narrow slot followed by a wide bar. Odd and even field patterns alternate about the circumference of the coding ring, except for one "home," or "synch" position having three sequential odd patterns to signify completion of a full revolution of the reel. The coded data provides an easily recognizable indication of the direction of reel rotation, which may be used to generate an error signal if the reels are spinning the wrong way.

In another aspect of the present invention, each of the sensors cooperates with the coded data of its corresponding reel to output a pattern of signals marking the beginning and end of at least two arcuate portions of each reel during its rotation. Apparatus responsive to each sensor is provided for comparing the durations of the two arcuate portions of its corresponding reel, and for generating an acceleration error signal if the duration of the first arcuate portion is greater than the second. In the preferred embodiment, each field of the above-mentioned coding ring comprises one such arcuate portion, and an acceleration error test is performed after each field passes its corresponding sensor.

In yet another aspect of the invention, the two above-mentioned equal arcuate portions of each reel are sensed as the reel rotates, and their durations are compared. Apparatus responsive to this comparison generates a deceleration error signal if the duration of the first arcuate portion is less than the second by more than a predetermined deceleration error amount. In the preferred embodiment, this deceleration error test may be performed in conjunction with the above-mentioned acceleration error test, depending on whether the first or second arcuate portion is longer.

Another aspect of the present invention requires each sensor to cooperate with the coded data of its corresponding reel to output a pattern of signals marking the beginning and end of at least one arcuate portion of the reel. Apparatus is provided which responds to each sensor during rotation of its corresponding reel for providing a slow speed error signal if the duration of the arcuate portion of its corresponding reel is greater than a predetermined minimum speed amount. In the preferred embodiment, each field of the coding ring represents such an arcuate portion, and a test is made after each field passes its corresponding sensor to determine whether the corresponding reel is rotating too slowly. In addition, a fast speed error signal is issued if a field's duration is less than a predetermined maximum speed amount.

A further aspect of the invention relates to an amusement machine having a rotatable reel with a corresponding sensor, the reel having a region of coded data circumferentially arranged about its axis. The region comprises a plurality of fields corresponding to a plurality of indicia disposed about the reel, each field spanning a unique portion of the region and comprising a portion of the coded data corresponding to its respective indicium. Apparatus responsive to the sensor is provided for counting an aggregate number of fields past the sensor after reel spin has started, without regard for the rotational position of the reel. A random number generator provides a number to a device which issues a reel stop signal when the randomly generated number has been counted by the aggregate number counter. A reel stopping device responds to the reel stop signal, bringing the reel to rest at a stopping position. Since there is no way to tell where the reel will stop from the contents of the aggregate number counter, a reel position determining means is provided which is responsive to the sensor for determining the stopping position of the reel relative to a fixed reference point.

In this aspect of the invention, it will be appreciated that the randomly generated number, which is used to assure an unpredictable result in the reel's stopping position, does not bear any correlation to the intended stopping position of the reel. Accordingly, it is not possible to tap a storage register containing the random number in order to alter the ultimate stopping position of a spinning reel.

In the portions of the preferred embodiment corresponding to this aspect of the invention, a three reel, 32 field slot machine is provided in which the user signals the start of a reel spinning operation by pulling a handle. Three random numbers are generated, the first of which is greater than 32 to assure at least one full revolution of the reels. After a brief delay, the first random number is loaded in an aggregate number counter and decremented once after each field of the first reel passes its sensor. In addition, a reel position determining device, comprising a second counter, waits for the "home" or "synch" position of the first reel to pass its sensor, and then proceeds to increment the second counter. After the first reel's random number has been counted down to zero, a stopping solenoid is fired to stop its rotation. The second random number is then loaded in the aggregate number counter and counted down to zero while another reel position counter monitors the actual rotational position of that reel. The procedure is then repeated for the third random number and reel. After the third reel has stopped, the three reels will display a randomly determined sequence of indicia which bears no relation to the three random numbers which were used to achieve this sequence.

One other aspect of the invention relates to an amusement machine having a reel with a single track comprising a continuous array of fields, each having one high and one low state of different arcuate spans. The fields of the array have like arcuate spans, and the sequence of longer and shorter span states in the fields alternate about the array. A sensor is positioned to detect movement of the fields past a single point at a fixed radial distance from the reel's axis, and the sensor cooperates with the track to output a pattern of high and low signals as the track rotates. Apparatus responsive to the sensor output may then be used for determining the rotational position of the track according to the pattern of high or low signals. In the preferred embodiment, the array of alternating fields of each reel comprises all but one field on the track, the remaining field having the same sequence of span states as its two adjoining fields, thus creating a "home" position which may be used to zero the reel's rotational position counter.

From the above summary, it will be appreciated that the present invention provides a simple, accurate and essentially tamper-proof apparatus for monitoring the reels of an amusement machine. The simplicity of the machine reduces construction costs, maintenance and repair so that the owner can minimize machine down time, optimize play time, and thus increase the profits he can derive from the machine while assuring a greater degree of security from unauthorized tampering than has been available in prior art devices.

BRIEF DESCRIPTION OF THE DRAWINGS

FIGS. 10A to 10E are flow charts illustrating the processing steps performed by the microprocessor during an interrupt routine.

DESCRIPTION OF THE PREFERRED EMBODIMENT

Figure 1:
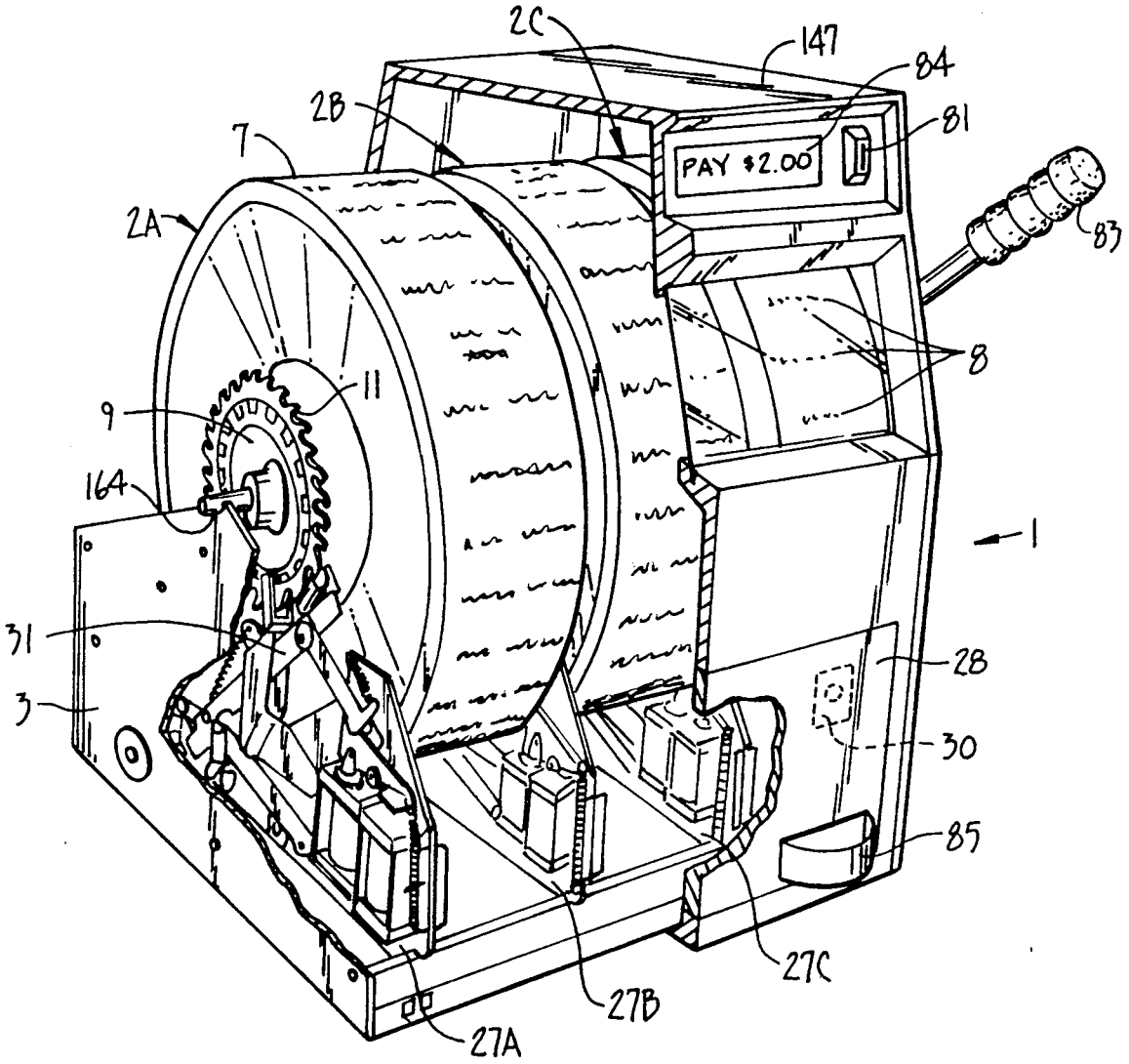
FIG. 1 is a perspective view of a slot machine according to the present invention, having portions cut away to expose the reels and rotation governing modules.

A preferred embodiment of the present invention will now be described with reference to a coin-operated slot machine 1, as seen in FIG. 1, having three coaxially mounted reels 2A, 2B and 2C which are simultaneously spun and, after a period of free wheeling rotation, are independently stopped at a set of randomly determined stopping positions. For ease of reference, the mechanical operation of this embodiment will be briefly described below. A more thorough treatment of the mechanical structure and operation of this device may be found in U.S. patent application Ser. No. 664,185, filed Oct. 24, 1984 (Amusement Machine), which is incorporated herein by reference.

Figure 2:
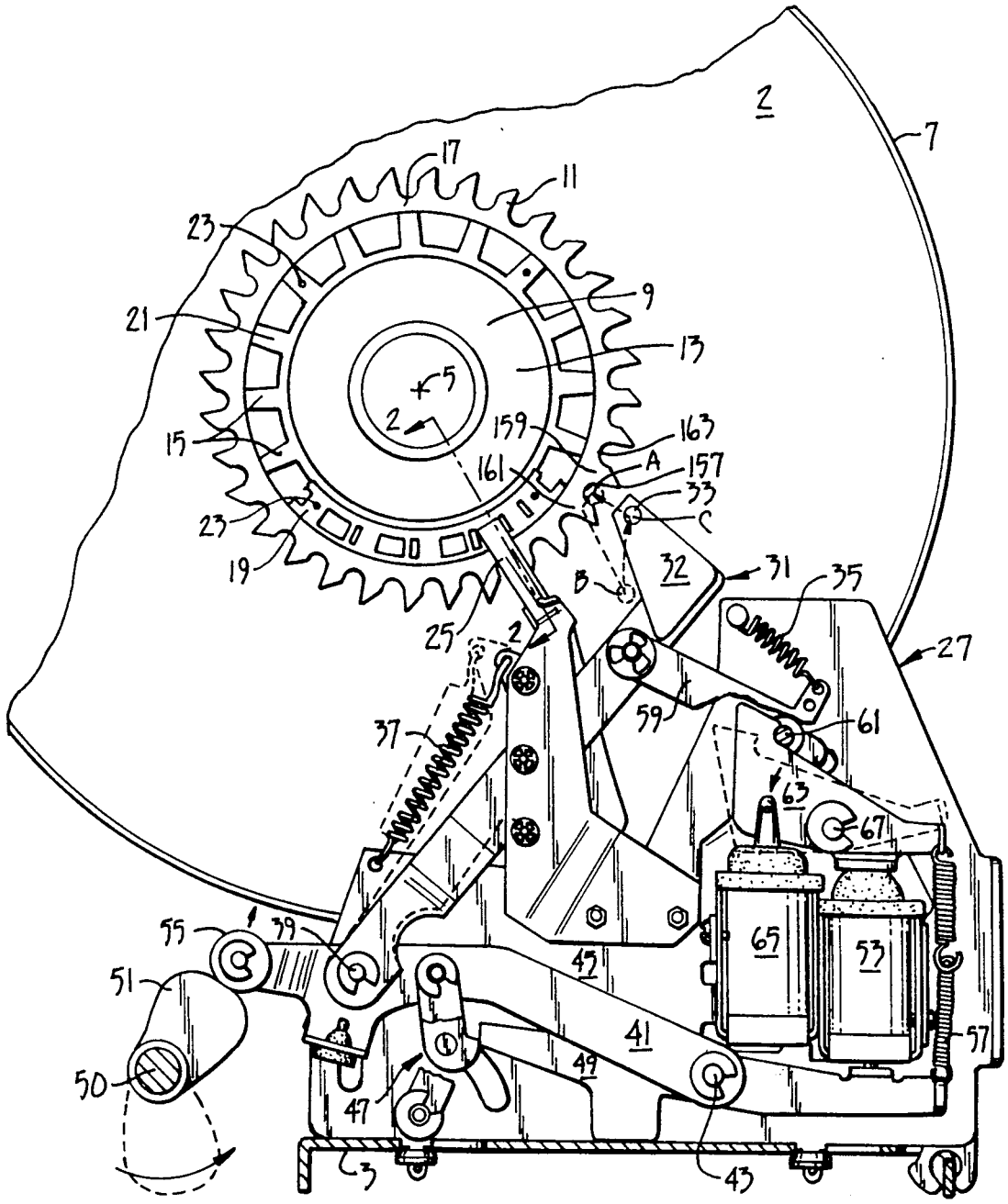
FIG. 2 is an elevational view of a reel and its corresponding sprocket and rotation governing module illustrating the three phases of module operation.
Figure 3:
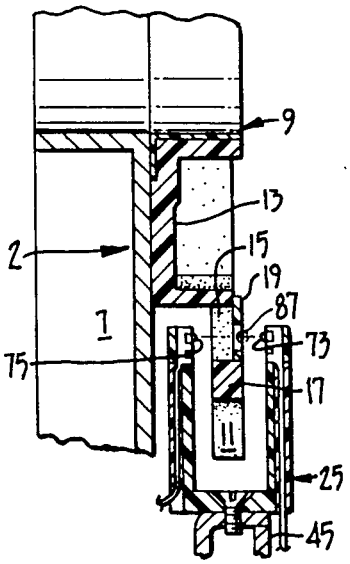
FIG. 3 is a sectional view along line 3—3 of FIG. 2.

FIGS. 2 and 3 illustrate one of the three reels of the preferred embodiment, and a corresponding rotation governing module which is used to start and stop the reel's rotation. Reel 2 measures 12¾" in diameter, and is mounted in a frame 3 for rotation about an axis 5. The reel 2 has a flange, or rim 7 at its outer periphery which bears various game playing indicia 8, such as cherries, oranges, gold bars and other readily identifiable symbols, at designated locations. In the embodiment described, thirty-two indicia 8 are equally spaced about the peripheral rim 7 of reel 2, corresponding to the thirty-two discrete stopping positions of the reel.

A sprocket 9, having thirty-two teeth 11 equally spaced about its outer periphery, is coaxially mounted for rotation with reel 2. The sprocket measures 5.25" in diameter to the tips of teeth 11, and 4.8" in diameter with respect to the gaps between the teeth. Sprocket 9 comprises a hub 13 having sixteen equally spaced spokes 15 extending radially outwardly to support a ring 17 of teeth 11 at the sprocket's outer periphery. A thin, stamped coding ring 19, having a pattern of slots which will be discussed in detail below, is seated against spokes 15 in a recessed region 21 radially inward of peripheral ring 17, and held in place by mounting pegs 23. A photoelectric sensor 25 straddles the peripheral ring 17 and coding ring 19, as seen in FIG. 3, and cooperates with coding ring 19 to monitor the rotation of reel 3 in a manner more fully described below.

Figure 7:
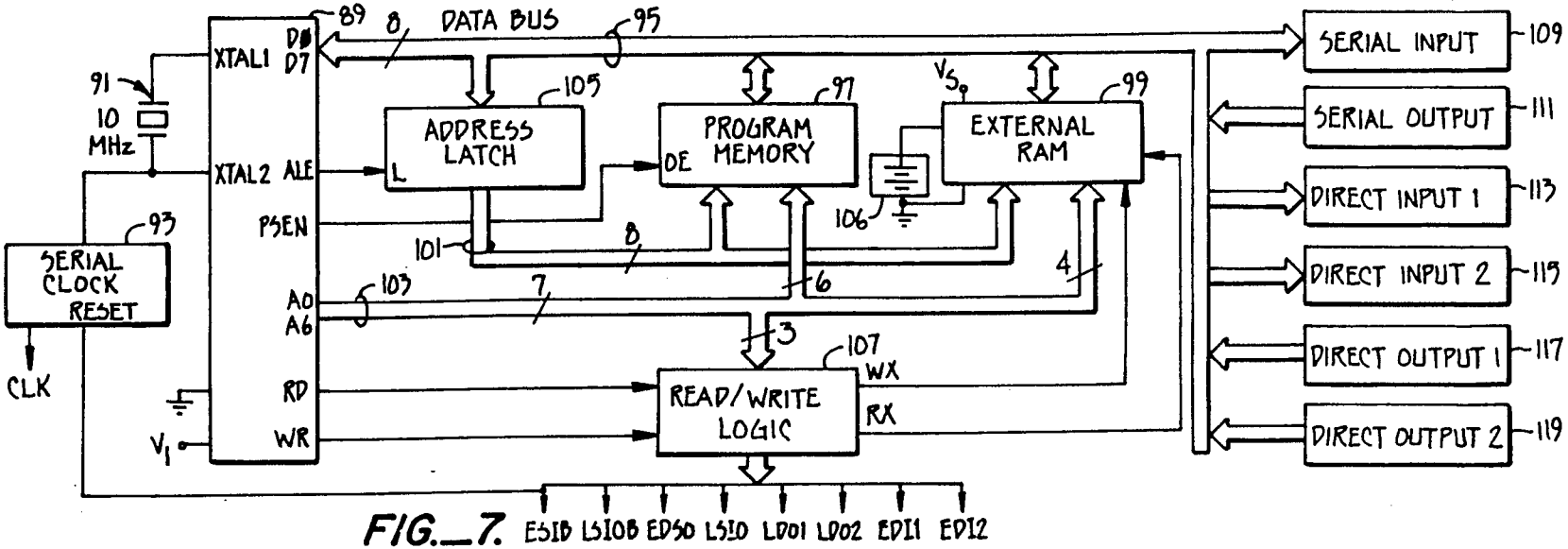
FIG. 7 is a schematic diagram of a microprocessor-based control circuit according to the present invention, for monitoring reel rotation and providing appropriate error detection signals.

A rotation governing module, indicated generally at 27, is fixed to frame 3 adjacent its corresponding reel 2, to alternately spin and stop the reel's rotation in response to electrical signals from a control circuit 29 (FIG. 7). Module 27 comprises a rigid pawl arm 31 which moves through a three-phase movement in response to control circuit 29, so as to initiate a period of free-wheeling reel spin and then stop the reel at one of the stopping positions defined by teeth 11.

The upper end of pawl arm 31 supports resilient stop head 32 having a pin 33 which engages the teeth 11 of sprocket 9 when the reel is at rest, as seen at position A in dotted lines in FIG. 2. In this REEL SET position, pawl arm 31 experiences light tension from stop spring 35, which urges pin 33 in a generally radial direction against peripheral ring 17, and strong tension from start spring 37, which urges pawl arm 33 generally downwardly against pivot pin 39 on guide arm 41. Guide arm 41 is pivotally mounted on pin 43, which is fixed to base plate 45. It is held in the position shown in FIG. 2, against the pressure of start spring 37, by toggle link 47, which is locked in the extended position shown by trip lever 49. Cam 51 is positioned as seen in dotted lines in FIG. 2, enabling guide arm 41 to move downwardly during the first phase of pawl arm movement.

Figure 4A:
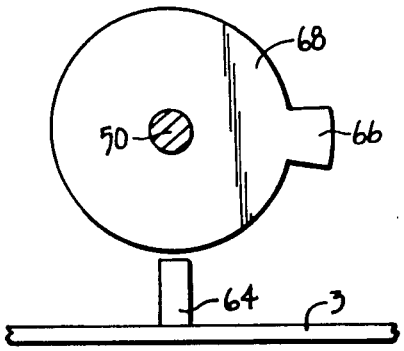
FIGS. 4A and 4B are elevational views illustrating a cocking motor for the rotation governing module of FIG. 2, and its associated position sensing apparatus.
Figure 4B:
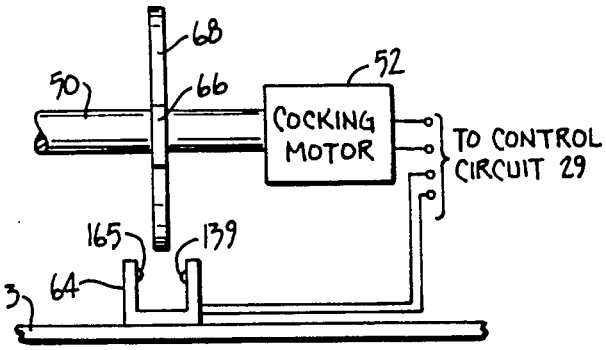

Rotation of reel 2 is initiated when control circuit 29 issues a START SPIN signal to starting solenoid 53, which pushes downwardly against first trip lever 49, rotating the trip lever in a clockwise direction about pin 43. As the left end of first trip lever 49 clears toggle link 47, the toggle link collapses under the pressure of start spring 37, causing guide arm 41 to rapidly pivot counterclockwise about pin 43, drawing pawl arm 31 downwardly and causing pin 33 to move from position A to position B along the dotted path shown in the drawing. This initiates a free-wheeling rotation of reel 2 at approximately one revolution per second. Camshaft 50 is then rotated by electric cocking motor 52 (FIG. 4), causing cam 51 to turn in a counterclockwise direction, engaging cam follower 55 and lifting guide arm 41 to the position seen in the drawing. The left end of first trip lever 49 then drops down, under tension of spring 57, to lock toggle link 47 in the position shown. This lifting action of cam 51 causes pawl arm 31 to move through a second phase of movement, from the above-described REEL SPIN position to the COCKED position illustrated in solid lines. During this movement, pin 33 travels along the dotted path of FIG. 2 from position B to position C, causing stop spring 35 and start spring 37 to be stretched in preparation for the following two phases of pawl arm movement. In its stretched state, stop spring 35 applies strong tension to a stop lever 59 which joins the upper end of pawl arm 31 to a pin 61 slidably mounted on base plate 45. A second trip lever 63 engages pin 61 during the second phase of pawl arm movement, restraining the leftward movement of stop lever 59 as pawl arm 31 is raised to the COCKED position, thus stretching spring 35 in preparation for the third phase of pawl arm movement. After camshaft 50 has completed one full revolution, an optical camshaft sensor 64 (FIGS. 4A and 4B) detects the presence of finger 66 in camshaft positioning disc 68, and signals control circuit 29 to turn off cocking motor 52, as described more fully below.

In the third phase of movement, pawl arm 31 pivots about pin 39 from the COCKED position (solid lines) to the REEL SET position discussed above, carrying pin 33 along the dotted path of FIG. 2 from position C to position A. The third phase movement is initiated when control circuit 29 issues a STOP SPIN signal to stopping solenoid 65, which pulls second trip lever 63 in a counterclockwise direction about pin 67, to the position seen in dotted lines in FIG. 2. This releases pin 61, enabling stop lever 59 to push pawl arm 31 upwardly and to the left under pressure of stop spring 35, causing pin 33 to lodge between two adjoining teeth 11 of sprocket 9 and stop the rotation of reel 2 at one of the thirty-two stopping positions defined by the teeth.

The position and movement of each reel 2 are constantly monitored to assure that unauthorized personnel cannot interrupt the randomness of a reel spinning operation or change the stopping positions of the reels in between rounds of game play. Reel monitoring is performed by the interaction of sensor 25 and coding ring 19, in conjunction with control circuit 29.

Figure 5:
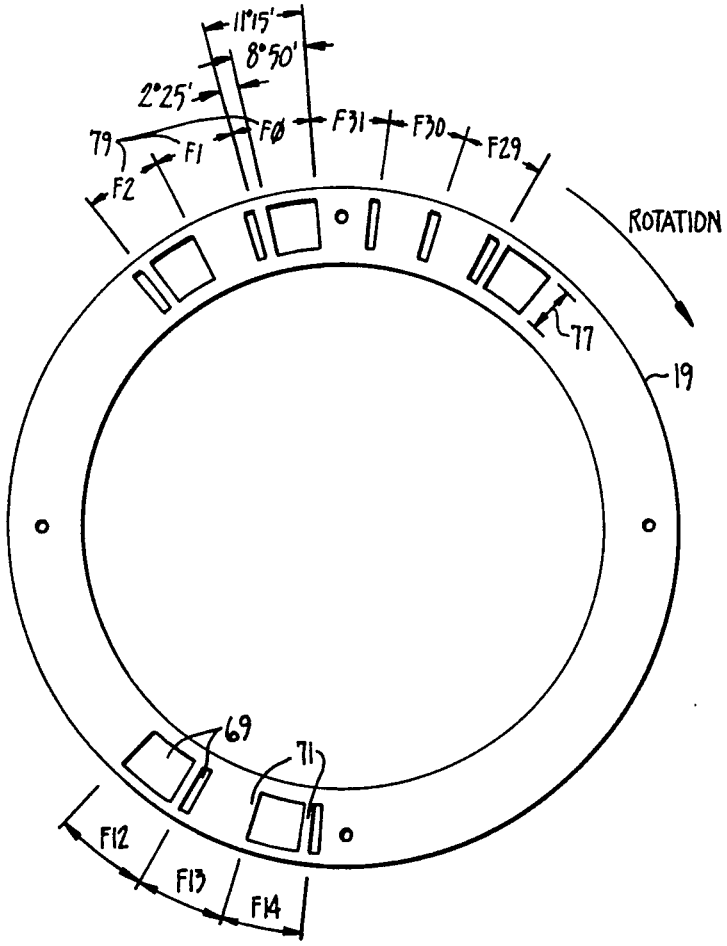
FIG. 5 is an elevational view of a coding ring used with each reel of the preferred embodiment to monitor its reel's rotation.

FIG. 5 illustrates the preferred construction of coding ring 19, which comprises a thin, stamped aluminum ring having a plurality of wide and narrow slots 69 stamped out of the ring at predetermined locations. Slots 69 are separated by wide and narrow opaque "bars" 71, or solid portions of the ring separating two adjacent slots. As seen in FIG. 3, sensor 25 comprises a U-shaped bracket which straddles sprocket 9, having an opposed pair of photo-optic elements consisting of an LED 73 on one arm of the U and a phototransistor 75 opposite LED 73, on the other arm of the U. LED 73 and phototransistor 75 are positioned in alignment with the slots 69 and bars 71 of coding disk 19, which form a single "track" 77 of information that may be read by the sensor 25 as reel 2 rotates, to monitor the reel's position and movement.

As reel 2 rotates, track 77 continuously passes between the photo-optic elements 73 and 75. LED 73 is pulsed at periodic intervals, and phototransistor 75 is sampled during these intervals, to determine whether or not it is receiving light from its opposed LED. If a bar 71, or opaque region of coding ring 19 is separating the photo-optic elements, the phototransistor 75 will indicate a "low" (digital zero) electrical state, while a slot 69 interposed between the photo-optic elements will permit light to pass from the LED 73 to the phototransistor 75, which will then indicate a "high" (digital one) electrical state. The rotation of reel 2 thus produces a digital signal at the output of phototransistor 75, modulated at the sampling frequency, having pulse widths that vary according to the speed of the rotating reel and the type (wide or narrow) of slot or bar presently between the photo-optic elements.

As seen in FIG. 5, track 77 is divided into thirty-two fields 79, corresponding to the thirty-two stopping positions defined by sprocket teeth 11, each field having an arcuate span, or "width," of 11°15′. Each field 79 is divided into two segments, one being a slot 69 and the other a bar 71. When the reel 2 is rotating in the proper direction (clockwise with respect to FIG. 5), the first segment of each field "seen" by sensor 25 will be a slot and the second segment will be a bar. The fields alternate between odd and even patterns, corresponding to the odd numbered and even numbered stopping positions of sprocket 9, with the exception of field F30, which has an odd pattern.

The first field, F0, which corresponds to the first stopping position of reel 2, contains an "even" pattern of a relatively wide slot 69 followed by a relatively narrow bar 71. In the embodiment described, a "wide" slot has the same arcuate span as a "wide" bar, occupying 8°50′ of the 11°15′ field width. Likewise, a "narrow" slot has the same arcuate span as a "narrow" bar, occupying 2°25′ the field width. Field F1, which corresponds to the second stopping position, displays an "odd" pattern of a narrow slot followed by a wide bar. Field F2 then repeats the even pattern of Field F0, and the sequence of alternating odd and even patterns continues about the circumference of coding ring 19 through field F29, which displays the odd pattern of a narrow slot followed by a wide bar. The next field, F30, contains another odd pattern, thus breaking the chain of alternating odd and even patterns. The last field, F31, also contains an odd pattern. Accordingly, the three sequential odd patterns of fields F29, F30 and F31 establish a "home" or "synch" position on the coding ring 19 which identifies the end of one complete revolution of the corresponding reel 2.

General Operation

In operation, a user initiates a round of game play with slot machine 1 by inserting a coin into coin slot 81 and pulling handle 83 forward. The movement of handle 83 closes a switch (not shown), causing a HANDLE PULLED signal to be transmitted to control circuit 29. The control circuit transmits a signal to start solenoids 53A, 53B and 53C, causing their respective pawl arms 31 to move from the REEL SET position to the REEL SPIN position described above, thus initiating a period of free wheeling reel spin for each of the three reels at a rate of approximately one revolution per second.

After handle 83 has been pulled, control circuit 29 generates three random numbers which are used to determine the next set of stopping positions for the three reels. Starting with the first reel, 2A, control circuit 29 loads the first random number into an aggregate number counter and samples sensor 25 at 500 microsecond intervals, to determine when the sampled output of phototransistor 75 undergoes a positive transition from a low to a high state, indicating the beginning of a new field. Each time a new field is sensed, control circuit 29 decrements the aggregate number counter and tests to see if the new aggregate number is greater than zero. When the aggregate number equals zero, control circuit 29 stops the spinning of reel 2A by transmitting a signal to energize its corresponding stopping solenoid 65. The second random number is then loaded into the aggregate number counter, and the countdown is repeated for reel 2B. When the aggregate number counter equals zero, reel 2B is stopped by energizing its corresponding stopping solenoid 65, and an aggregate number countdown is begun for reel 2C with the third random number. When the aggregate number counter again equals zero, the stopping solenoid 65 of reel 2C is energized to stop that reel and complete the round of game play. The stopping positions of reels 2A, 2B and 2C are then compared to a payout table and, if a winning combination is present, control circuit 29 indicates this fact to the user by means of an appropriate display 84 and/or payout of coins from an internal hopper (not shown) to coin receptacle 85.

After all three reels have stopped, control circuit 29 continues to sample phototransistors 75, at 500 microsecond intervals, during the "idle" mode in between rounds of game play. If a transition is sensed between any two successive samples of a given phototransistor during the idle mode, control circuit 29 transmits a "tilt" or error signal to indicate that improper reel movement has taken place, and inhibits subsequent game play until the tilt condition has been corrected.

During the above-described period of free wheeling reel spin, each reel is closely monitored to assure that its free spinning is not tampered with by the user. After a brief initialization period following the pulling of handle 83, the control circuit 29 performs a test every 500 microseconds to ensure that each reel has the proper rotational direction, speed, and acceleration, and to update the instantaneous rotational position of each reel.

Figure 6A:
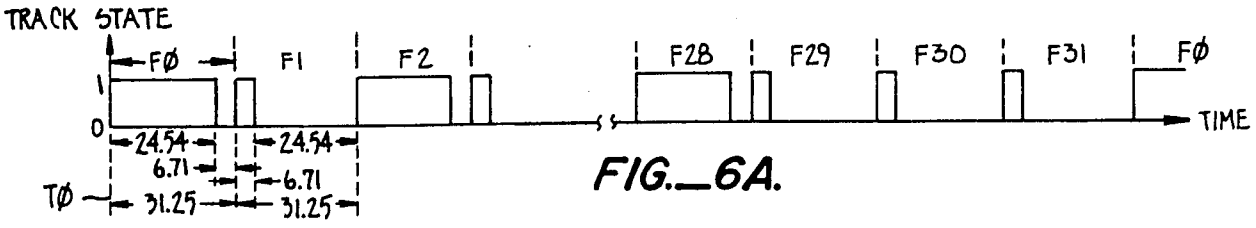
FIG. 6A and 6B are timing diagrams of track state versus time for the coding ring of FIG. 5 during clockwise and counter-clockwise rotational movement.

The use of two different segment widths in each field of coding disk 19 enables control circuit 29 to monitor the rotational direction of each reel 2. FIG. 6A illustrates the pattern of slots 69 and bars 71 displayed by track 77 at a single, fixed point monitored by phototransistor 75, as reel 2 rotates in the correct (clockwise) direction at a constant rate of one revolution per second. At time zero (T0), field F0 begins to cross the single point, or "sensing zone" 87 upon which sensor 25 is focused. At this time, the state of track 77 undergoes a positive transition (from zero to 1), marking the start of a new field. The durations of the next two segments are monitored by control circuit 29, for use in determining the reel's rotational direction. When the next positive transition occurs (after 31.25 milliseconds), indicating the end of F0 and the beginning of F1, control circuit 29 compares the durations of the first and second segments of field F0. After determining that the first segment is longer (24.54 milliseconds versus 6.71 milliseconds), it divides the longer segment by two compares the modified duration (12.27 milliseconds) to the shorter segment. Since the modified segment is still greater than the unmodified segment, control circuit 29 determines that the reel is spinning in the correct rotational direction, and repeats the computation for the next field.

Figure 6B:
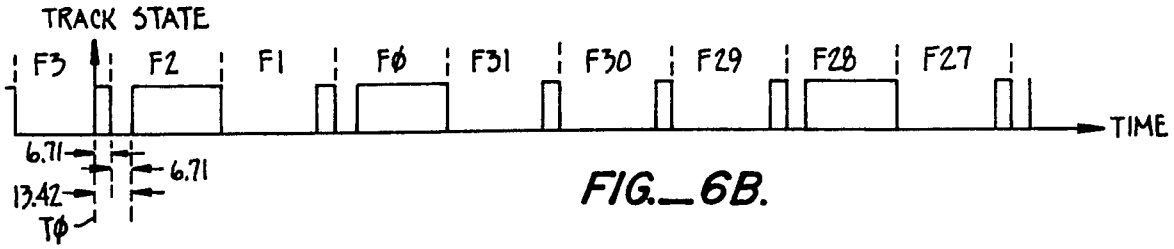

FIG. 6B is a graph of track state versus time for a reel which is spinning in the wrong (counter-clockwise) rotational direction at a constant rate of one revolution per second. At time zero (T0), a positive transition will be detected when the slot 69 of field F3 enters the sensing zone 87. Since control circuit 29 interprets this as the start of a new field 79, it will monitor the durations of the next two segments, and, at the next positive transition (13.2 milliseconds), will compare the segments to determine which is larger. In the present example, since the two segments are equal, one of them will be assigned a default status as the "larger segment," and will then be divided by two to provide a modified segment duration. The modified duration (3.355 milliseconds) will then be compared to the duration of the "shorter" segment (6.71 milliseconds) and, upon determining that it is not greater, control circuit 29 will issue an "error" or "tilt" signal indicating that the reel is not spinning in the correct rotational direction.

After determining that a given reel is spinning in the correct rotational direction, control circuit 29 compares the total duration of a prior field to a predetermined "minimum speed" duration, and issues an error signal if the reel is spinning at a rate less than the predetermined minimum rotational speed. The prior field duration is then compared to a predetermined "maximum speed" duration and an error signal is generated if the reel is spinning too fast.

Next, the durations of the prior and newly-completed fields are subtracted from each other and the difference is tested to determine whether the reel is accelerating or decelerating. If accelerating, the difference is tested against a maximum acceleration amount and, if greater, an error signal is generated. Likewise if the reel is decelerating, the difference is tested against a maximum deceleration amount and an error signal is generated if the reel is decelerating too quickly.

After testing for acceleration or deceleration, control circuit 29 determines whether the newly completed field contained an "odd" pattern (e.g. F1, F3, F5) or an "even" pattern (e.g. F0, F2, F4), by testing to see which one of the field's two segments was longer. If odd, it determines whether three sequential odd fields have been sensed, and if so, it clears a rotational position counter corresponding to that reel. If not, it increments the position counter and proceeds to the next reel, repeating the above-described test.

Control Circuit 29

FIG. 7 is a block diagram of a control circuit 29 constructed in accordance with the present invention. The embodiment shown employs an 8 bit microprocessor 89, such as an Intel 8031, to control and monitor the spinning and stopping of reels 2, as well as performing other processing operations, such as coin handling and audio-visual displays. A functional diagram of the Intel 8031 microprocessor, as well as its features, specifications, and instructions, may be found in the publication entitled "MCS 51 User's Manual," published by Intel Corporation in July, 1981, which is incorporated in this specification by reference. Terminals XTAL1 and XTAL2 of microprocessor 89 are connected to an exterior oscillator 91, which provides a 10 megahertz (MHz) signal to time the operations of microprocessor 89. Oscillator 91 is also connected to a serial I/O clock 93, for timing the input and output of serial data, as described more fully below.

Terminals D0 to D7 of microprocessor 89 are connected to an 8 bit data bus 95, which is used for transmission of data to and from a plurality of external apparatus such as sensors, solenoids, relays, and audiovisual displays. Data bus 95 also carries the eight lower order bits for addressing external memory, as described below.

Memory storage in control circuit 29 is distributed between the internal memory of microprocessor 89 and external memory storage provided by program memory 97 and external RAM 99. The internal memory of microprocessor 89 comprises an internal RAM having thirty-two general purpose registers for temporary storage, each holding one byte (eight bits) of information, and one hundred twenty eight assigned function registers, each holding one byte of information which is assigned to a specified memory function, such as storing the present rotational position of an associated reel 2.

Addressing of external memory is accomplished by data bus 95, lower address bus 101 (8 bits), upper address bus 103 (7 bits) and address latch 105. Address latch 105 comprises eight D-type latches with a common latch enable control gate L. Address latch 105 latches the eight bits of information from data bus 95 to lower address bus 101 when gate L is pulsed, and provide that information at its output after the latching pulse has been withdrawn.

Program memory 97 comprises a 128 kilobits nonvolatile EPROM, which responds to an output enable pulse at terminal OE to access the memory location identified by upper and lower address busses 103 and 101, and transmit the 8 bit contents of that memory location to data bus 95. When microprocessor 89 is ready to receive a new instruction, it sends the eight lower address bits of the next instruction to terminals D0 to D7, and pulses terminal ALE (Address Latch Enable) so as to latch this data from data bus 95 onto lower address bus 101 via address latch 105. The microprocessor then sends the six upper order address bits of the next instruction to terminals A0 to A5, and transmits a pulse at terminal PSEN (Pulse Enable). Upon receipt of the signal from PSEN, program memory 97 will retrieve the next instruction (or eight bit portion of an instruction) from the address location identified by upper and lower address busses 103 and 101 and will load the eight bit contents of that address location onto data bus 95 for transmission to terminals D0 to D7 of the microprocessor.

External RAM 99 comprises a two kilobyte CMOS RAM which supplements the microprocessor's internal RAM and provides a temporary storage device for critical data in the event of a power failure, as will be discussed below. Since the CMOS RAM is a volatile memory device, a battery-powered electrical back up system 106 is provided to maintain the information in external RAM 99 in the event of a temporary power loss at its voltage supply terminal $V_S$. An example of such a battery backed CMOS memory device may be found in U.S. patent application Ser. No. 447,358 filed Dec. 6, 1982 (Device for Maintaining Game State Audit Trail Upon Instantaneous Power Failure), which is incorporated herein by reference. External RAM 99 responds to inputs from upper and lower address busses 103, 101 and Read/Write logic 107, so as to either store the byte of information on data bus 95 at the specified address or to transmit the contents of the addressed register to the data bus, for receipt by microprocessor 89 at terminals D0 to D7. When microprocessor 89 wishes to read the contents of a particular address location in external RAM 99, it loads the lower order address bits onto data bus 95 at terminals D0 to D7, and pulses terminal ALE to latch this information to lower order address bus 101. The microprocessor then loads the seven upper order address bits on upper address bus 103, which transmits the four least significant bits of the upper order address (at terminals A0 to A3) to external RAM 99, and transmits the three most significant bits of the upper order address (terminals A0 to A6) to Read/-Write logic 107 while pulsing read terminal RD. Read/-Write Logic 107 then demultiplexes the three coded bits of data from upper address bus 103 in conjunction with the pulse from the RD terminal and transmits a signal RX (Read external RAM) to external RAM 99. Upon receipt of the RX pulse, external RAM 99 will retrieve the contents stored at the 12 bit address location on address busses 103, 101 and output these contents to data bus 95 for receipt by the microprocessor at terminals D0 to D7.

When microprocessor 89 wishes to write, or store a byte of data at a given address location in external RAM 99, it again latches the lower order address information to lower order address bus 101 via address latch 105. Microprocessor 89 then transmits the four upper order address bits to terminals A0 to A3, and the three bit code for external RAM 99 to terminals A4 to A6. Read/Write Logic 107 then demultiplexes the external RAM code, and, in conjunction with a pulse from the write terminal WR of microprocessor 89, transmits a signal WX (Write to external RAM) to external RAM 99. At the same time, microprocessor 89 will load the eight bits of data it wishes to store in external RAM onto data bus 95 via terminals D0 to D7. Upon receipt of the WX signal, external RAM 99 will read the data from data bus 95 and store it at the twelve bit address location specified on data busses 103 and 101.

Figure 8:
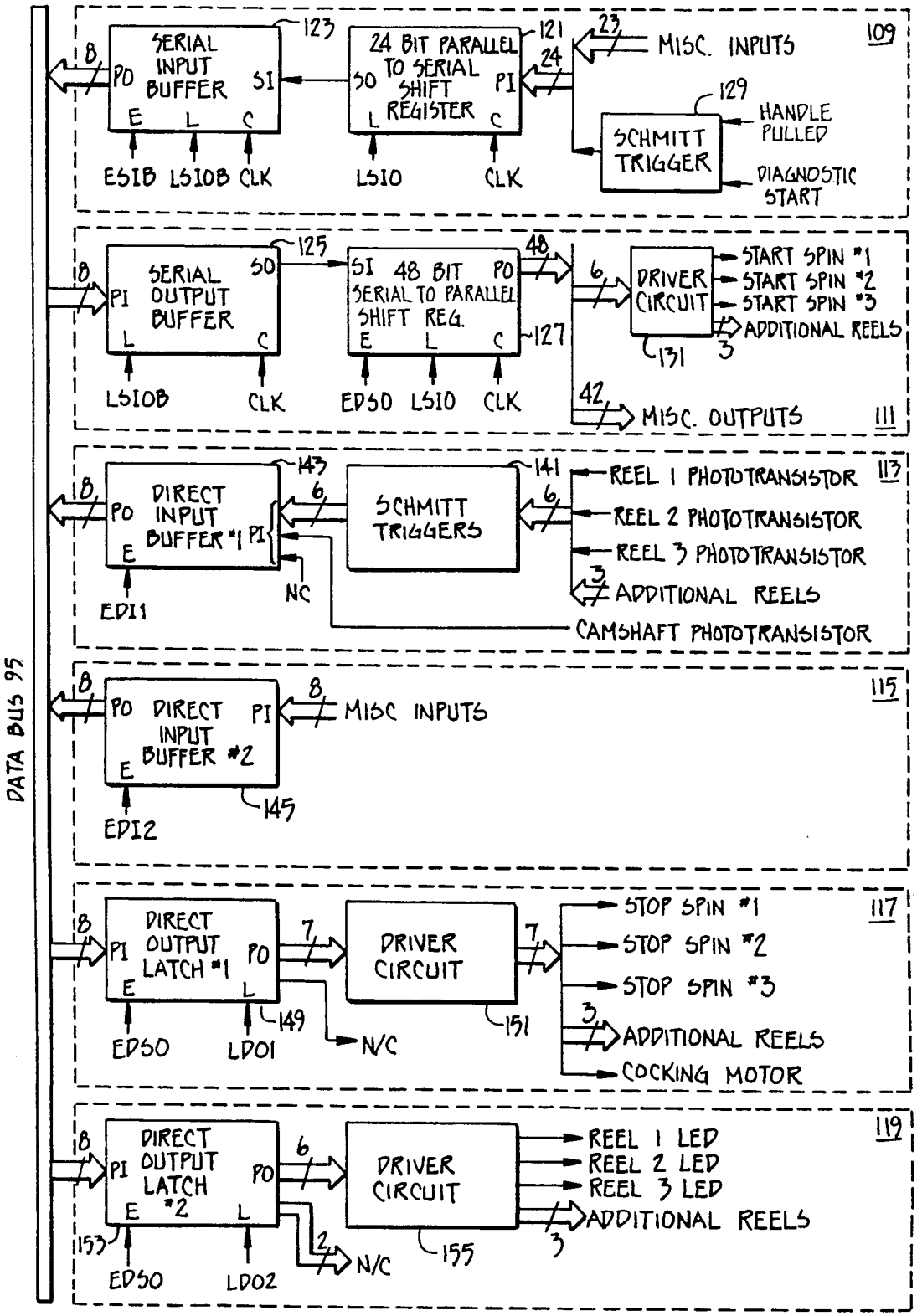
FIG. 8 is a schematic diagram illustrating the input and output circuitry of the control circuit of FIG. 7.

Read/Write Logic 107 is also used to demultiplex the signals from microprocessor 89 regarding serial and direct (parallel) input and output (I/O) to and from microprocessor 89. As seen in FIG. 7, microprocessor 89 communicates with external apparatus (such as sensors, solenoids, relays and audio-visual display) through serial input and output circuits 109 and 111, first and second direct input circuits 113 and 115, and first and second direct output circuits 117 and 119. A more detailed block diagram of these circuits is provided in FIG. 8 which illustrates the transfer of information to and from various circuit components of amusement machine 1.

Microprocessor 89 is programmed to transmit or receive data in one of two alternate manners, serially or directly, depending on the speed with which that data must be processed. Data which need not be processed immediately is handled in a serial manner and is updated every three milliseconds. On the other hand, data which must be processed more quickly than this is transmitted and received by microprocessor 89 in a direct manner, more fully described below.

The preferred embodiment of control circuit 29 provides 48 serial outputs and 18 serial inputs. While the following discussion will concentrate on the inputs and outputs used in performing the reel monitoring function of the present invention, it will be understood that the control circuit 29 described must handle additional, or "miscellaneous" inputs and outputs such as sensors and audio-visual displays, which communicate with a user and/or serviceman to inform them of machine status conditions.

Serial input and output circuits 109, 111 operate in conjunction with clock pulses from serial clock 93, and latching and enabling pulses from Read/Write Logic 107, to communicate serial input and output information from and to microprocessor 89 on the eight bit databus 95.

Serial input circuit 109 uses a 24 bit parallel to serial shift register 121 to multiplex twenty-four separate digital input signals for transmission to microprocessor 89. Shift register 121 comprises a two stage device having twenty-four input terminals PI, one serial output terminal SO, a data latching terminal L, and a clock pulse terminal C. Upon receipt of signal LSIO (latch serial input/output) at terminal L, the data appearing on parallel input terminals PI of shift register 121 is latched into a first stage, twenty-four bit buffer, and applied to the inputs of a second stage, 24 bit parallel to serial shift register. With each subsequent clock pulse CLK received at terminal C of shift register 121, the latched data is shifted up by one bit, thus supplying the next bit of serial input data at terminal SO.

The output of shift register 121 is fed to the serial input terminal SI of serial input buffer 123, which buffers the serial data prior to its transmission to microprocessor 89. Serial input buffer 123 comprises a three stage device having a single serial input SI, eight parallel output terminals PO, and clock, latch and enable terminals C, L and E. The first stage of serial input buffer 123 comprises a serial to parallel eight bit shift register which shifts in the data appearing at terminal SI each time a clock pulse CLK is received at terminal C. The second stage of serial input buffer 123 comprises an eight bit latch which latches the eight bits of data from the first stage to the second stage outputs in response to latching pulse LSIOB (latch serial input/output buffer) at terminal L. After the second stage has latched the data from the first stage, subsequent clock pulses at terminal C may continue to shift in serial data without affecting the second stage output. The third stage of serial input buffer 123 comprises a three state (high, low or off) output buffer which responds to enabling signal ESIB (enable serial input buffer) so as to gate the second stage output bits to the eight parallel output terminals PO, and to provide a high impedance output (off) when terminal E is not being pulsed.

Serial output circuit 111 comprises a serial output buffer 125 which receives six successive bytes of data from microprocessor 89 via databus 95 and transfers it in serial form to a forty-eight bit serial to parallel shift register 127, which outputs the data in parallel form so as to control up to forty-eight external devices. Serial output buffer 125 comprises a two-stage, eight bit device which operates in a similar manner to the twenty-four bit parallel to serial shift register 121 discussed above. Serial output buffer 125 has eight parallel input terminals PI for receiving data from databus 95, a single serial output terminal SO for transmitting the data in serial form to forty-eight bit shift register 127, and latch and clock terminals L and C for controlling the transfer of information from parallel to serial form. Upon receipt of pulse LSIOB (latch serial I/O buffer) at terminal L of buffer 125, the eight bits of data at parallel inputs PI are latched into a first stage, 8 bit buffer and applied to the inputs of a second stage, 8 bit parallel to serial shift register. Subsequent receipt of clock pulses CLK at terminal C of serial output buffer 125 shifts the latched data to serial output terminal SO, through the second stage shift register, for transmission to forty-eight bit shift register 127.

Forty-eight bit shift register 127 comprises a three-stage device which operates in a similar manner to the eight bit serial input buffer 123. Shift register 127 has a serial input terminal SI, forty-eight parallel output terminals PO, and enable, latch, and clock terminals E, L and C for controlling the transfer of information between the three stages. Upon receipt of clock signal CLK at terminal C, the single bit of data at terminal SI is shifted into a first state, serial to parallel shift register. After the first stage has been filled with forty-eight serial bits of data, the first stage outputs are latched to the second stage outputs upon receipt of pulse LSIO at terminal L. The third stage output buffer is responsive to signal EDSO (enable direct and serial outputs) for gating the second stage outputs to terminals PO, providing control signals for up to forty-eight external devices. Signal EDSO comprises a "watch-dog" signal, which enables all direct and serial outputs during normal operation of control circuit 29, and disables (or shuts down) all outputs in case of microprocessor program failure.

Serial I/O is performed in a six-part cycle, in accordance with a Serial I/O Interrupt routine which performs one of the six-parts of the serial I/O cycle (hereafter "I/O cycle") each time it is run. Microprocessor 89 is programmed to initiate a new Interrupt routine every 250 microseconds, which alternately performs forms a routine controlling the spinning and stopping of reels 2 (hereafter "Reel Control Interrupt") or a routine for processing serial I/O (hereafter "Serial I/O Interrupt"). Accordingly, a new Serial I/O Interrupt is initiated every 500 microseconds, resulting in an I/O cycle of six Serial I/O Interrupts or three milliseconds. During each Serial I/O Interrupt, microprocessor 89 loads a new byte of serial output data on databus 95 and instructs I/O Logic 107 to "write" this data into serial output buffer 125 by sending a three bit serial buffer code to microprocessor terminals A4 to A6 and sending a "write" pulse to terminal WR. Read/Write Logic 107 demultiplexes these signals from microprocessor 89 and transmits pulse LSIOB (latch serial I/O buffer) to serial input buffer 123 and serial output buffer 125. This signal writes the byte on databus 95 into serial output buffer 125 by latching the byte into the buffer's first stage. At the same time, LSIOB latches one byte of serial input data from the first stage (serial to parallel shift register) to the second stage (octal latch) of serial input buffer 123, in preparation for the reading of this serial input byte by microprocessor 89. Next, the microprocessor reads the byte of serial information that was latched into serial input buffer 123 by pulsing terminal RD while providing the three bit serial buffer code at terminals A4 to A6. These signals are demultiplexed by Read/-Write Logic 107, which then transmits signal ESIB (enable serial input buffer) to serial input buffer 123 and to the reset terminal of serial clock 93. Upon receipt of ESIB, the byte of serial data which was latched into buffer 123 is delivered to databus 95 and read by the microprocessor at terminals D0 to D7.

ESIB is also used to reset serial counter 93 and initiate a new series of clock pulses CLK. Serial clock 93 receives a ten megahertz signal from oscillator 91, and, after dividing this signal to a lower frequency by conventional digital counting logic, outputs a clock signal CLK comprising an eight pulse "burst" which is emitted once every 500 milliseconds in response to the resetting of clock signal ESIB.

Clock signal CLK is transmitted to twenty-four bit shift register 121, serial input buffer 123, serial output buffer 125 and forty-eight bit shift register 127, to clock the flow of serial information through serial input and output circuits 109 and 111. Upon receipt of the eight bit pulse burst of CLK, eight bits of data are serially shifted out of twenty-four bit shift register 121 and into the first stage of serial input buffer 123. At the same time, the eight pulse burst of CLK clocks the eight bits of data in serial output buffer 125 into the first stage of forty-eight bit shift register 127. When the next Serial I/O Interrupt occurs, another byte of serial data is written into serial output buffer 125 from microprocessor 89, and the first stage data of serial input buffer 123 is latched into the second stage and read by the microprocessor. This process continues for six Serial I/O Interrupts, after which all twenty-four bits of shift register 121 will have been read into registers SINB1, SINB2 and SINB3 (serial input bytes 1, 2 and 3) of the microprocessor's internal RAM, and forty-eight bits of serial output will have been clocked into the first stage of shift register 127 from internal RAM registers SOUTB1-SOUTB6 (serial output bytes 1–6). It will be understood that, while serial input buffer 123 is enabled during each Serial I/O Interrupt by pulsing ESIB, only three of the Serial I/O Interrupts in a six-part I/O cycle actually transfer serial input data to the microprocessor; accordingly, the "data" (or noise) enabled from serial input buffer 123 during the other three Serial I/O Interrupts is not stored in internal RAM.

At the start of the next Serial I/O Interrupt (the first Serial I/O Interrupt of the following I/O cycle), microprocessor 89 loads serial shift registers 121 and 127 with new data by sending a three bit code to terminals A4 to A6 and pulsing terminal RD. Read/Write Logic 107 demultiplexes these signals and transmits latching pulse LSIO (latch serial I/O) to serial shift registers 121 and 127. Following this latching operation, the forty-eight parallel output terminals PO of shift register 127 will contain the six bytes of serial output data sent by microprocessor 89 during the preceding I/O cycle, for use in controlling up to forty-eight external apparatus during the present I/O cycle, and shift register 121 will contain the latest sampling of data from its twenty-four parallel input terminals PI, to be shifted out and read by microprocessor 89 during the present I/O cycle.

Control circuit 29 now proceeds with another cycle of six Serial I/O Interrupts, repeating this cycle every three milliseconds to obtain updated samplings of the twenty-four input signals and provide updated control signals to its forty-eight serial outputs.

Of the twenty-four input signals appearing at terminals PI of twenty-four bit shift register 121, twenty-three signals comprise miscellaneous inputs which are unrelated to the present invention, and will thus be referred to collectively in this specification. The remaining input signal is provided by handle 83, which closes a switch (not shown) when pulled, at the start of a round of game play, causing a HANDLE PULLED signal to be sent to Schmitt trigger 129. Schmitt trigger 129 provides a clean digital signal to one of the twenty-four parallel inputs PI of shift register 121, which will be transferred to a designated bit of internal RAM register SINB1 by the end of the following I/O cycle.

Of the forty-eight output signals appearing at parallel output terminals PO of forty-eight bit shift register 127, forty-two signals comprise miscellaneous outputs which are unrelated to the present invention, and will thus be referred to collectively in this specification. The remaining six signals are provided to a driver circuit 131, which amplifies the signals sufficiently to drive the coils of starting solenoids 53. Three of these six START SPIN signals correspond to the three start solenoids S3 in the embodiment being discussed, and the other three signals may be used to control the starting solenoids of up to three additional reels if desired.

The six START SPIN signals are set according to the respective states of six corresponding bits in register SOUTB1, as will be discussed more fully below, under the heading Operation of Microprocessor 89. It will be appreciated that the numbers assigned to the six serial output registers and three serial input registers in this specification (e.g., SOUTB1, SINB1) are arbitrarily chosen. As such, these numbers are neither intended to reflect a preferred order in the processing of the six serial output bytes or three serial input bytes, nor correspond to the order of the six serial output registers and three serial input registers of the annexed microfiched appendix.

Control circuit 29 also provides direct (parallel) input and output of two bytes of data to and from the internal RAM of microprocessor 89. While most functions of control circuit 29 may be performed once every three milliseconds in accordance with the I/O cycle, certain functions demand more rapid decision making and control capability in order to achieve the unique features of the present-invention, such as the high-speed sampling of reel 2 by sensors 25. These functions are therefore controlled directly, outside of the I/O cycle by direct input circuits 113 and 115 and direct output circuits 117 and 119.

First direct input circuit 113 is used to transmit up to eight bits of data ("first direct input byte") regarding the state of reel phototransistors 75 and camshaft phototransistor 139 to microprocessor 89. It will be noted that while a three reel amusement machine is described herein for purposes of simplicity, control circuit 29 is designed so that it may be easily modified to accommodate up to three additional reels 2 by changing the microprocessor program instructions contained in program memory 97. In such a case, three of the four unused input bits of direct input circuit 113 may be used to monitor the phototransistors 75 of the additional reels. The fourth unused input bit will preferably not be connected, to simplify the programming of microprocessor 89. The six signals from reel phototransistors 75 are digitized by a set of six Schmitt triggers 141 and delivered to the parallel inputs PI of first direct input buffer 143, along with the input signal from camshaft phototransistor 139. Buffer 143 comprises an octal, three state buffer (low, high and "off") which transmits the eight bits of information at input terminals PI to output terminals PO in response to an enabling pulse at terminal E. When microprocessor 89 wishes to sample the first direct input byte, it transmits a three bit code corresponding to direct input circuit 113 to terminals A1 to A6, and pulses terminal RD. Read/Write Logic 107 demultiplexes the signals and transmits pulse EDI1 (enable direct input 1) to first direct input buffer 103, which transmits its byte of data to terminals D1 to D7 of microprocessor 89 via databus 95.

Second direct input circuit 115 operates in a similar manner to first direct input circuit 113 to transmit a second byte of direct input data ("second direct input byte") to microprocessor 89. Circuit 115 comprises a second direct input buffer 105 which functions in the same manner as first direct input buffer 143. Parallel input terminals PI of buffer 145 are connected to eight miscellaneous inputs, such as a phototransistor (not shown) for detecting the open or closed state of a door for accessing the interior of machine housing 147. When microprocessor 89 wishes to read the second direct input byte, it issues a three bit code to terminals A4 to A6 corresponding to second direct input circuit 115, and pulses terminal RD. I/O Logic 107 demultiplexes the signal and transmits pulse EDI2 (enable direct input 2) to the enabling gate E of buffer 145, causing the second direct input byte to be transmitted to terminals D0 to D7 of the microprocessor 89 via databus 95.

First and second direct output circuits 117 and 119 are used to output first and second bytes of control data to external apparatus requiring control signals at a faster rate than the three millisecond period of the I/O cycle. The first such byte of data ("first direct output byte") controls the energization of stop solenoids 65 and the on/off state of cocking motor 52. The second direct output byte controls the on/off state of LEDs 73 in sensors 25.

First direct output circuit 117 comprises a first direct output latch 149 comprising a two stage device for storing and transmitting the first direct output byte from microprocessor 89. The first stage comprises an octal latch which responds to a latching signal at terminal L for latching the data at input terminals PI to the first stage outputs. The second stage comprises a three state buffer which responds to an enabling signal at terminal E for gating the data from the first stage outputs to parallel output terminals PO. This data is then amplified by driver circuit 151 and sent to stopping solenoids 65 and cocking motor 52. When microprocessor 89 wishes to update the first direct output byte, it issues a three bit code corresponding to first direct output latch 149 to terminals A4 to A6 and pulses write terminal WR. I/O Logic 107 demultiplexes these signals and transmits latching pulse LDO1 (latch direct output 1) to first direct output latch 149. At the same time, microprocessor 89 transmits the byte of data at internal RAM register DOUTB1 (direct output byte 1) to terminals D0 to D7. This byte contains three bits corresponding to the three stopping solenoids 65 in the embodiment being discussed, and three bits which may be used to control the stopping solenoids of up to three additional reels. One bit is also used to control cocking motor 52. The remaining bit is preferably not connected, to simplify microprocessor programming.

Upon receipt of latching pulse LDO1, output latch 149 latches the data from DOUTB1 into its first stage. As discussed above, enabling signal EDSO is normally present, except in case of microprocessor program failure. Accordingly, the latched data is normally transmitted to output terminals PO, then amplified by driver circuit 151 and transmitted to stopping solenoids 65 and cocking motor 52. If the microprocessor program fails, EDSO is withdrawn and the second stage buffer of latch 149 is disabled, switching all outputs of latch 149 to a high impedance ("off") state.

Second direct output circuit 119 has similar circuitry to first direct output circuit 117, including a second direct output latch 153 and associated driver circuit 155. Second direct output latch 153 operates in the same manner as first direct output latch 149, responding to a latching signal at terminal L for latching data into its first stage and to an enabling signal at terminal E for enabling a second stage buffer to output the latched data. When microprocessor 89 wishes to update the second direct output byte, it transfers a byte of data to terminals D0 to D7, issues a three bit code corresponding to second direct output circuit 119 to terminals A4 to A6, and pulses write terminal WR. Read/Write Logic 107 demultiplexes the signals and transmits pulse LDO2 (Latch Direct Output 2) to terminal L of output latch 153, causing the second direct output byte to be latched into the first stage of second direct output latch 153. This byte contains three bits corresponding to the three LEDs 73 in the embodiment being discussed, and three bits which may be used to control the LEDs of up to three additional reels. The remaining two bits are preferably not connected, to simplify microprocessor programming.

Since enabling signal EDSO is normally present, the latched data will normally be passed through the second stage of second direct output latch 153 to driver circuit 155, which amplifies the signals and transmits them to LEDs 73. If the microprocessor program fails, signal EDSO will be withdrawn and the second stage buffer of latch 153 will be disabled, turning off the outputs of second direct output circuit 119.

Operation of Microprocessor 89

Microprocessor 89 operates in accordance with a program which is stored in program memory 97. The sequence of steps/performed by microprocessor 89 in accordance with the present invention are depicted in the flow charts of FIGS. 9 and 10. It will be appreciated that the a program capable of carrying out the sequence of events depicted in FIGS. 9 and 10 may take a wide variety of forms in accordance with the techniques of the individual programmer and the desired functions to be performed by the microprocessor in addition to the reel control and monitoring functions described below. However, in order to provide an example of one type of such program and associated circuitry presently being used by the applicant, the circuit diagrams and object code of a working embodiment of the invention are submitted with this specification as a microfiche appendix.

The operation of microprocessor 89 proceeds in accordance with a main program and a series of periodic Interrupt routines. Upon completion of a particular Interrupt routine, the microprocessor returns to the last instruction of the main program from which the Interrupt occurred, and proceeds to process the main program until another Interrupt request is received. The annexed drawings have been organized in accordance with this distinction, with FIGS. 9A to 9D illustrating the flow charts of the main program and FIGS. 10A to 10E illustrating the Interrupt routine. FIGS. 10A to 10 refer to the Reel Control Interrupt portion of the Interrupt routine, and FIG. 10E refers to the Serial I/O Interrupt portion. It will be appreciated that, when the term "Interrupt routine" is used in this specification without the designation "Reel Control" or "Serial I/O," it is intended to refer to the entire Interrupt routine illustrated in FIGS. 10A–10E.

Figure 9A:
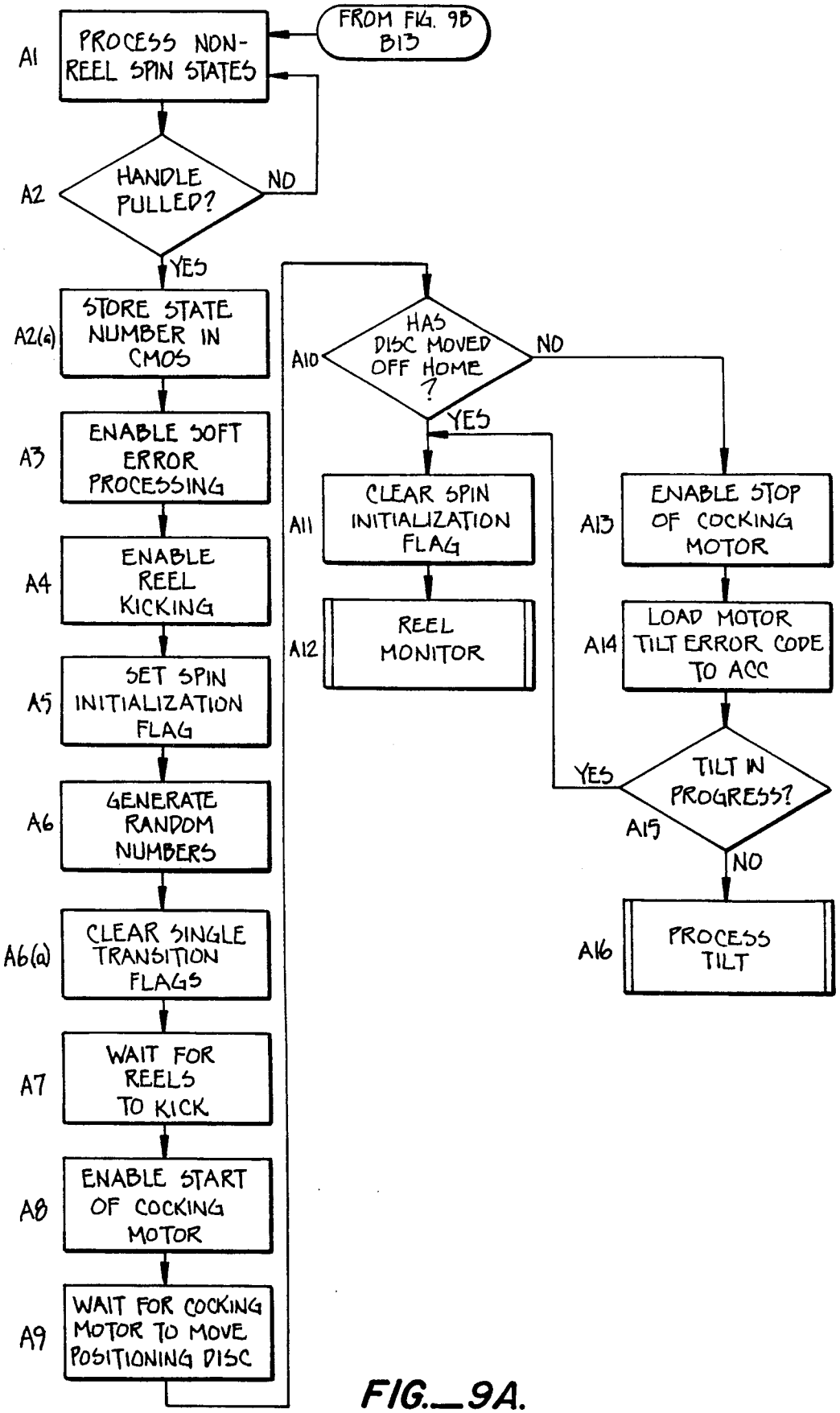
FIGS. 9A to 9D are flow charts illustrating the processing steps performed by the microprocessor of FIG. 7 during the main program.

The main program depicted in FIG. 9 is performed in a number of states, each processing information relating to a particular function of the amusement machine 1. For example, one state may control data processing during an "idle" mode in between rounds of game play. Another state may control machine operations after a player has inserted a coin, another state may evaluate the amount of money to be paid following a round of game play, and so on. These states may be referred to as "non-reel spin states," as they involve data processing operations which take place either before or after the spinning of reels 2 in a round of game play. These operations are referred to at step A1 of FIG. 9A, which illustrates the flow chart for initiating a reel spinning operation. At various points during the processing of the non-reel spin states, the microprocessor tests to determine if the handle 83 has been pulled, as indicated at step A2. If it has not been pulled, the program continues to process the non-reel spin states, until the next point is reached at which the microprocessor again tests to see if handle 83 has been pulled. More specifically, one of the twenty-four bits of serial input registers SINB-1–SINB3 is designated as the HP (handle pulled) flag. When handle 83 is pulled, the corresponding bit in shift register 121 is set upon receipt of signal LSIO, and the following I/O cycle transfers the content of that bit to flag HP. At step A2 in FIG. 9, the microprocessor tests HP and, if it is set, proceeds to the reel spin state which begins at the following step A2(*a*).

At step A2(*a*), microprocessor 89 stores a code number in eight bit CMOS register STATE/C (the notation "/C" will be used to indicate memory locations in CMOS external RAM 99) corresponding to the Reel Spin state. As discussed below, this register will be accessed after any power interruptions to determine whether the power was cutoff during the Reel Spin state.

At step A3, the microprocessor clears eight bit register XTRATR (extra transitions) and a bit, or "soft error flag" in eight bit register SOFTEN (Soft Error Enable) corresponding to each of the three reels, in preparation for a reel spinning operation. XTRATR and SOFTEN are used in connection with "soft error" processing, which is performed after each reel has stopped spinning to determine whether it has actually stopped at the rotational position counted by the microprocessor.

As discussed above, the signal to energize, or "fire" a given stop solenoid is sent when the field 79 of coding disc 19 on which the reel 2 is supposed to stop enters the sensing zone 87 of that reel's sensor 25. Since sampling of sensor 25 occurs every 500 microseconds, processing of the STOP SOLENOID signal is virtually instantaneous with respect to the 31.25 millisecond time period for passage of each field 79 during free wheeling reel spin. Consequently, the only substantial delay which occurs before the reel stops spinning is the stop response time, which is required for the stop solenoid to react and for the pawl arm 31 to move from the COCKED position to the REEL SET position after the stop solenoid releases it. This stop response time is normally on the order of 12 milliseconds, so, under normal stopping conditions, control circuit 29 should not sense any positive track state transitions after the stop solenoid pulse has been sent.

However, two factors may combine during the stopping of a reel to create a "false" positive transition; i.e., one which does not coincide with the entry of a new field 79 into sensing zone 87. The first such factor is an increased stop response time, which may result when slow solenoid response or abnormal pawl arm friction cause the pawl arm 31 to take longer than 12 milliseconds to move from the COCKED to the REEL SET position after the STOP SOLENOID pulse issues. In an extreme case, pin 33 may contact sprocket 9 just before the tip 157 (see FIG. 2) of the tooth 159 before which it was supposed to stop. This would allow sprocket 9 to rotate past the intended stopping point before being contacted by pin 33, and would then cause the sprocket to reverse its rotational direction as pin 33 moved from the tip of tooth 159 into the gap between teeth 159 and 161 (position A in FIG. 2).

The second factor which may contribute to a false positive transition is the springing action which occurs when the inertial movement of a spinning reel is abruptly stopped by pawl arm 31. In particular, the stopping of reel 2 causes flexing in resilient stop head 32 (FIG. 2) and axle 164 (FIG. 1) which allows sprocket 9 to move slightly past the position at which it is first contacted by pin 33, and then snap back (in the reverse rotational direction) after the rotational inertia of the spinning reel has been absorbed.

Since the above two factors permit some degree of overtravel in sprocket 9, it may be possible for a false positive transition to occur when a reel is stopping on an even field (other than F30). As seen in FIG. 6A, all even fields of coding disc 19, except F30, have an "even" field pattern defined by a wide (8°50′) slot (digital track state "1") followed by a narrow (2°25′) bar (state "0"), and all odd fields have an "odd" field pattern defined by a narrow slot followed by a wide bar. Accordingly, when sprocket 9 is being stopped on an even field pattern, it is possible for the sprocket to rotate beyond the negative transition at the end of the wide slot, then reverse its direction and snap back to the desired stopping position, causing a position transition. "Soft error" processing allows this to occur without issuing an error signal, and without incrementing the reel's corresponding 8-bit position counter RL(N)POS (reel "N" position) in internal RAM, as it usually does after a positive transition.

On the other hand, if the positive transition was the result of an exceedingly slow stop response time, causing pawl arm 31 to engage sprocket 9 after skipping past tooth 159, soft error processing will recognize this and increment the reel's position counter without issuing an error signal. In the preferred embodiment, the amount of overtravel resulting from mechanical flexion is sufficiently small that, if the track state undergoes a positive transition after the stop solenoid has been fired on an odd field pattern, it is certain that pin 33 has contacted tooth 159 after passing its tip 157. In this case, since sprocket 9 will continue to rotate until pin 33 lodges in the gap 163 beyond tooth 159, soft error processing will recognize this as a "true" positive transition and will therefore increment the reel's position counter. An error signal will only be generated if (after firing the stop solenoid on either an odd or even field) two positive transitions are detected before the sprocket comes to rest.

After enabling soft error processing at step A3 of FIG. 9 by clearing XTRATR and setting the reel bits in SOFTEN, the main program proceeds to step A4, in which three bits, or "reel start flags" corresponding to each of the three reels, are set in an eight bit register RLSTRT (reel start) of internal RAM, to be used during the following Reel Control Interrupt for firing the three starting solenoids 53.

The main program then proceeds to step A5 in which a one bit flag SPINIT (spin initialization) is set in internal RAM. This starts a spin initialization period during which the reels are spun, or "kicked" by their respective pawl arms 31, and their tracks 77 are sampled by sensors 25, but none of the rotation testing functions (direction, speed and acceleration) are performed, thus allowing the reels to reach a constant rotational speed without generating an error signal.

In order to facilitate a description of the steps performed by the main program of FIG. 9 and Interrupt routine of FIG. 10, it will be necessary to refer to reels 2A, 2B and 2C, respectively, as Reel (0), Reel (1) and Reel (2) in the following program description. It should be noted that the numbers 0, 1 and 2 used in this context are not to be confused with the reference numbers 2A, 2B and 2C of their corresponding reels, as set forth above with reference to FIG. 1.

At the next step A6, the main program instructs microprocessor 89 to generate three random numbers and store them in internal RAM registers RN0, RN1, and RN2 (random numbers 0, 1 and 2). The first random number, which is associated with the first reel (Reel (0), or reference number 2A) is selected with a lower limit of 32 and an upper limit 63, so that the first reel will make at least one full revolution (32 fields) before it is stopped. This assures that the synch position of fields F29, F30 and F31 will pass sensor 25 of Reel (0) at least once, to establish the correct rotational position in counter RL(0)POS. The second and third random numbers, which are respectively associated with the second reel (Reel (1), or 2B) and third reel (Reel (2), or 2C), are selected with a lower limit of six and an upper limit of eleven (all references to numbers other than 0 or 1 in this specification are in decimal, or base 10 notation). Since the second and third random numbers are sequentially counted down after the first random number, their respective reels will have already rotated at least one revolution before being counted down, and a lower limit of zero could be set without adverse effect. A lower limit of eight is preferred, though, so as to emphasize the sequential reel stopping effect familiar to slot machine users.

At step A6*a*, the microprocessor clears an 8-bit CMOS register SGLTRF/C (single transistor flag in CMOS external RAM 99). This register contains a one-bit "single transition flag" for each reel, which will be used during subsequent Interrupt routines to determine whether its corresponding reel began spinning after it was kicked.

At step A7, the main program loops for 50 milliseconds while the reels are kicked. The 50 millisecond delay allows the pawl arms 31 to finish traveling from their respective REEL SET to REEL SPIN positions before starting cocking motor 52.

At step A8, one of the bits of first direct output byte DOUTB1 corresponding to cocking motor 52 is set, enabling the cocking motor to be turned on during the following I/O Interrupt. The main program then loops for 350 milliseconds at step A9 to allow sufficient time for cocking motor 52 to move camshaft positioning disc 68 off the "home" position provided by finger 66. It then tests register LASTVAL at step A10 to determine whether the motor 52 has moved. LASTVAL (last value) is an eight bit register in internal RAM which stores the state of the inputs to direct input circuit 113 during the last Reel Control Interrupt. Accordingly, one of the bits in LASTVAL contains the most recent sample of phototransistor 139 in camshaft sensor 64. If this bit is high, microprocessor 89 determines that camshaft positioning disc 68 has moved off the home position, so motor 52 is functioning properly. If it is low, this indicates finger 66 is blocking the path of light from LED 165 to phototransistor 139, and that cocking motor 52 is either stopped or moving too slowly, thus requiring servicing.

If camshaft positioning disc 68 has moved off home at step A10, the main program clears the SPINIT flag at step A11 so that all rotation testing functions may now be performed during subsequent Reel Control Interrupts. The main program then proceeds to step A12 and performs the Reel Monitor routine, discussed below.

If disc 68 has not moved off home at step A10, the cocking motor bit of register DOUTB1 is cleared at step A13, enabling motor 52 to be turned off during the next Reel Control Interrupt. The program then loads a Motor Tilt Error code into the microprocessor's accumulator, and tests at step A15 to see if a tilt (from another source of error) is already in progress. If not, the program branches to a Process Tilt routine at step A16, as is well known in the art. In the Process Tilt routine, control circuit 29 stops normal operations and sends a MOTOR TILT error signal to a location, such as a memory register or LED, which may be checked by a service person to determine the cause of the tilt condition.

Reel Monitor Routine

Figures 9B, 9C:
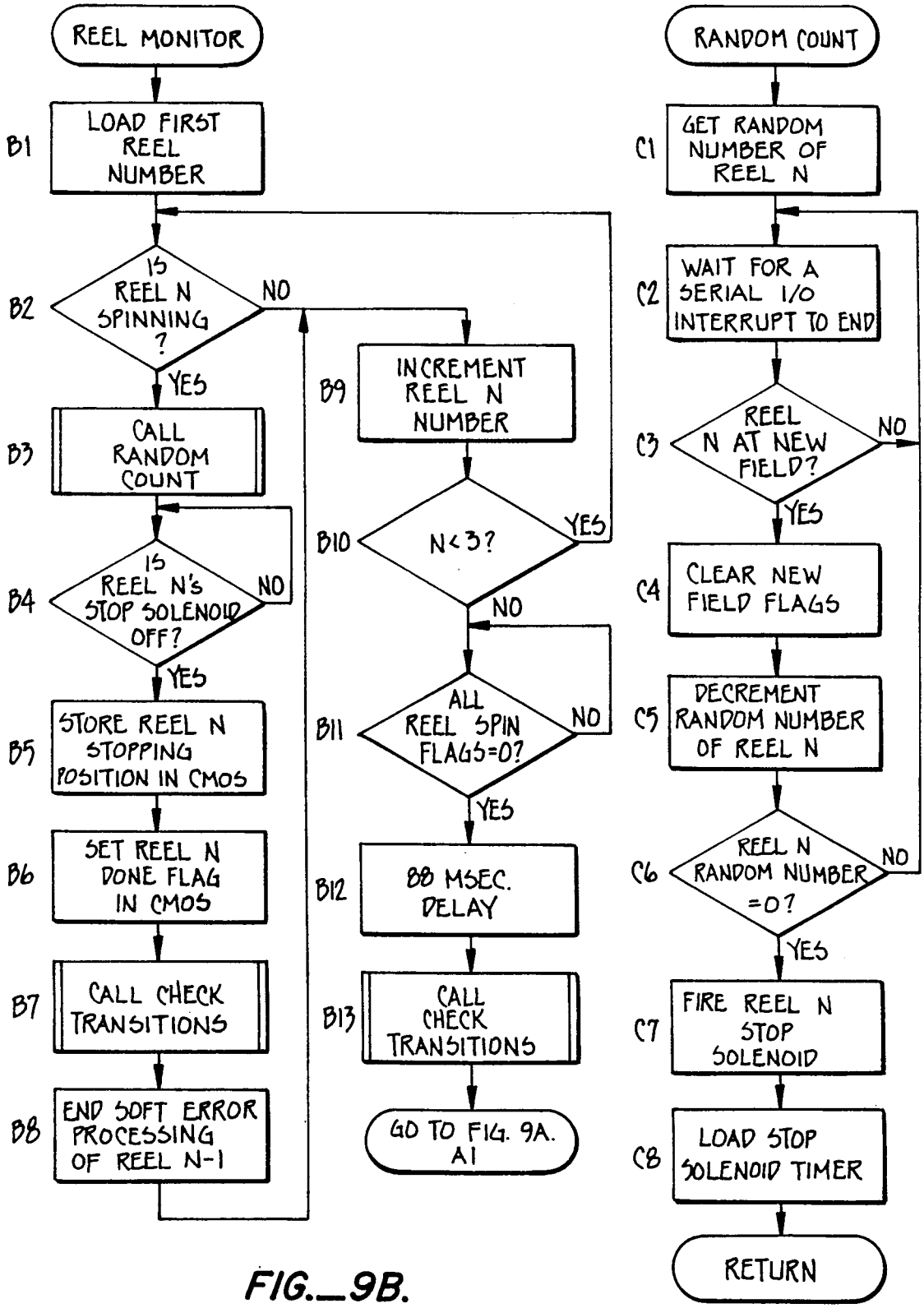
Figure 9D:
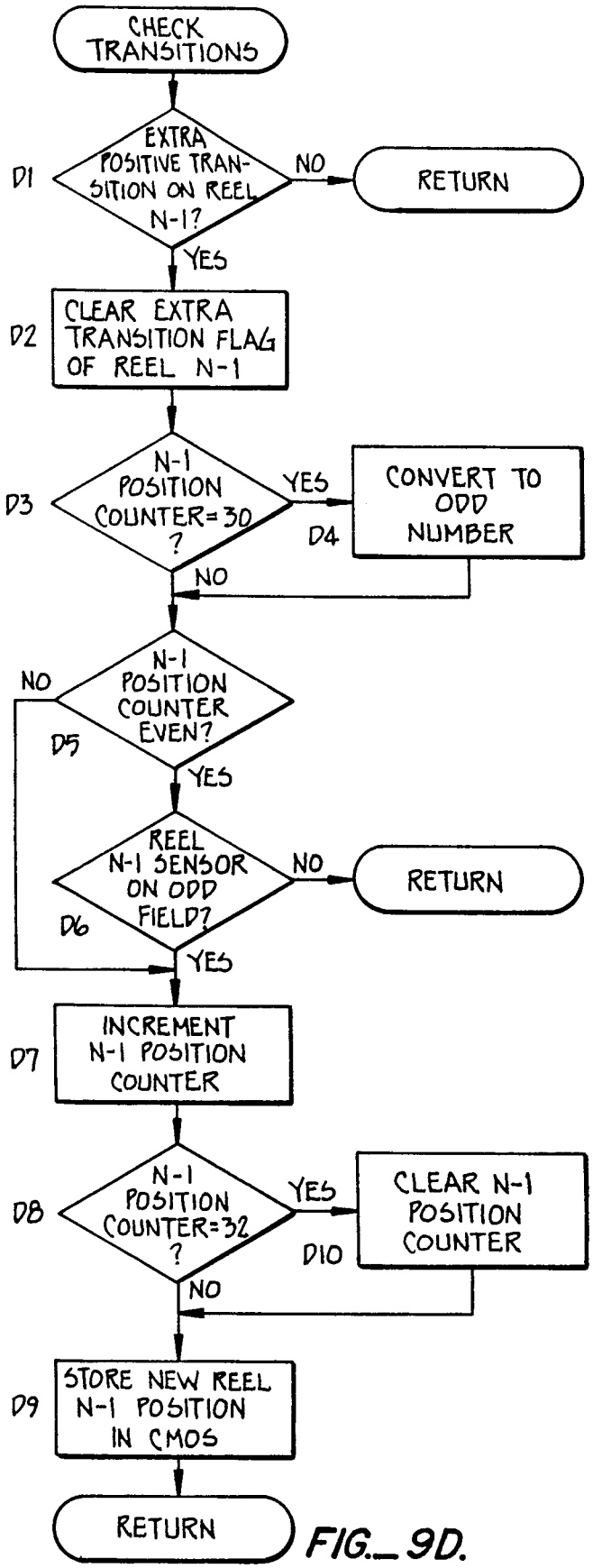
Figure 10A:
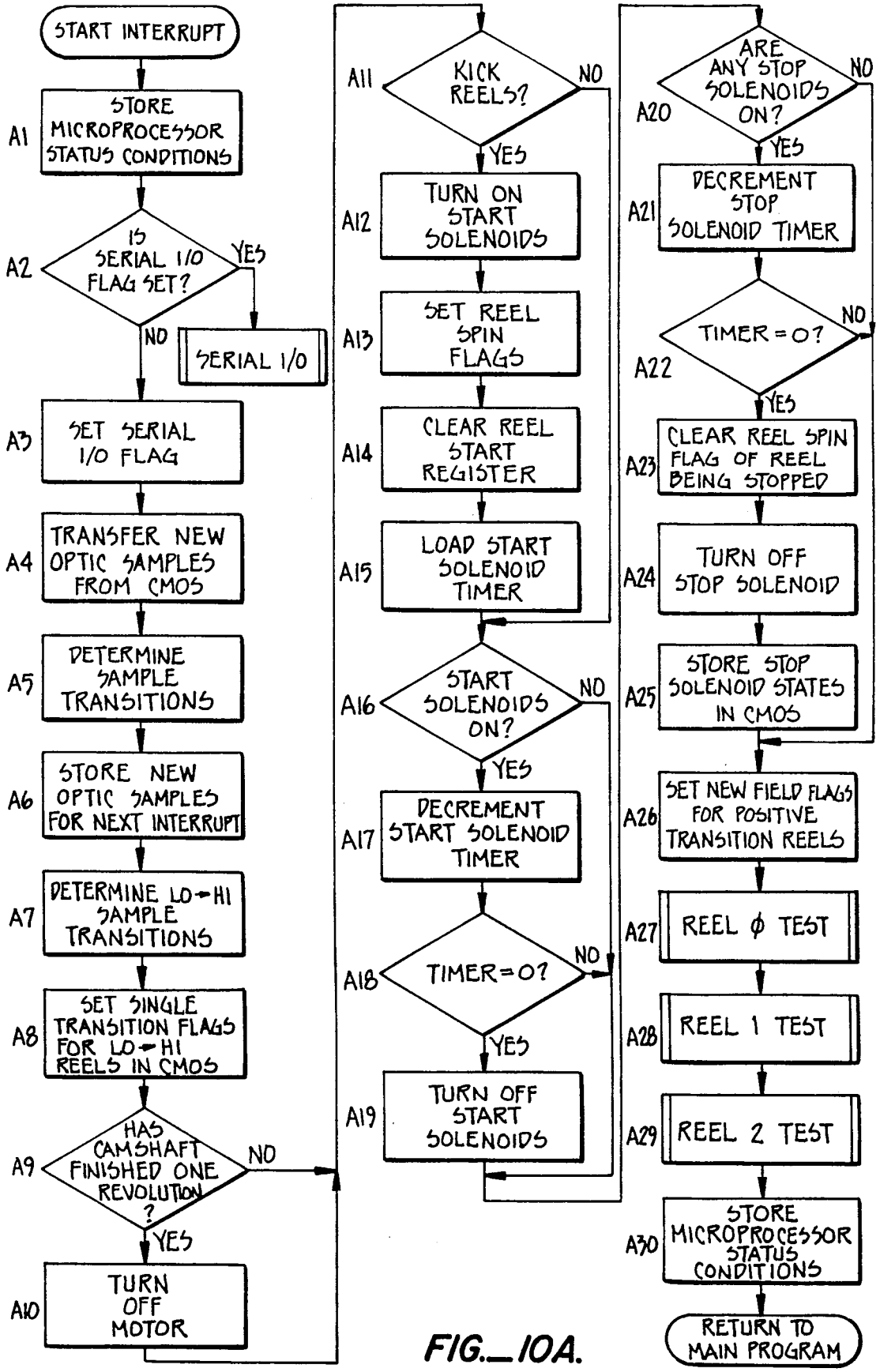

FIGS. 9B–9D illustrate the operational steps of microprocessor 89 in the Reel Monitor Routine, and its imbedded Random Count and Check Transitions subroutines. During the Reel Monitor routine the main program counts down the generated random number for each reel in conjunction with Interrupt routines that monitor the reels' rotational position, then stops the reel and checks to make sure it has stopped at the intended rotational position.

At step B1, the number 0 is loaded into a general purpose register TEMP1 (the notation TEMPX will be used to identify general purpose, or "temporary" register number X) in internal RAM corresponding to Reel (0), the first reel to be counted down. After each reel has been counted down, the number N in TEMP1 will be incremented by one to indicate which reel is presently being monitored. Thus if N=0, the routine will monitor reel 2A; if N=1, it will monitor reel 2B; and if N=2, it will monitor reel 2C.

At step B2, the program determines whether reel "N" (the reel whose number is in TEMP1; in this case Reel (0)) is spinning by testing register RLSPNF (reel spin flag) to see whether the bit corresponding to Reel (N) has been set. RLSPNF is an eight bit register in internal RAM which is set in the first Reel Control Interrupt after handle 83 is pulled, and cleared one bit at a time in the Interrupt routines as the stopping solenoid 65 corresponding to that bit is fired. If the Reel "N" bit of RLSPNF is set, the program proceeds to step B3 at which the Random Count subroutine is called. Random Count, which will be discussed below with reference to FIG. 9C, obtains the random number which has been generated for Reel (N), decrements it each time a new field passes sensor 25, and enables the firing of Reel (N)'s stopping solenoid 65. It then returns the program to step B4 of FIG. 9B, where the program again tests the Reel (N) bit of RLSPNF, and loops until it is cleared (in an Interrupt routine), indicating that the stopping solenoid of Reel (N) has been de-energized and the reel is not (or should not be) spinning.

At step B5, the contents of reel position counter RL(N)POS are transmitted to register RL(N)POS/C in CMOS External RAM 99, to preserve its contents in case of a power interruption that would otherwise erase the data in the microprocessor's volatile internal RAM. When the reels are spinning, control circuit 29 samples sensor 25 of each reel during each Reel Control Interrupt. If one of the reels has moved to a new field, the contents of that reel's position counter are incremented by one to indicate the present rotational position of its corresponding reel. Accordingly, by transferring these contents to CMOS memory at step B5, after Reel (N) has stopped, the microprocessor will be able to determine whether that reel moved while power was off, and take appropriate action as discussed below.

At step B6, a bit corresponding to Reel (N) is set in eight bit CMOS register DONE/C to indicate that reel has been done (i.e., spun to a new rotational position and stopped). In the event of a power interruption, the microprocessor will follow a power-on procedure in which it first checks register STATE/C to see if the Reel Spin state was being processed when the power was interrupted. If so, it tests register DONE/C to see if all the reel bits of that register were set. If not, the microprocessor generates new random numbers for the reels which were not set (i.e., had not finished spinning when the power was cut off), respins those reels and stops them according to their new random numbers. The microprocessor also respins the reels whose DONE/C bits were set, but does not generate new random numbers; these reels are stopped at the same position they were in when the power was interrupted, as stored in register RL(N)POS/C corresponding to each such reel.

If all the reel bits of DONE/C were set before the power was interrupted, or if the microprocessor was not in the Reel Spin state, the microprocessor respins all reels and returns them to the positions stored in RL(N)POS/C, where they were stopped before the power interruption occurred.

After the Reel (N) bit of register DONE/C has been set at step B6 of the Reel Monitor routine, the main program proceeds to step B7 at which the Check Transitions subroutine is called. The Check Transitions subroutine, which will be discussed below with reference to FIG. 9D, is used in conjunction with register XTRATR to determine whether the reel which was stopped in the previous iteration of Reel Monitor routine steps B2 to B10 (i.e., Reel (N−1) has made an extra positive field state transition, if so, to determine whether that reel's position counter RL(N−1)POS should be corrected.

After the main p has returned from the Check Transitions subroutine of step B7, it proceeds to B8 at which the bit corresponding to Reel (N−1) in the SOFTEN register is cleared. This signifies end of soft error processing for Reel (N−1) so that, if any positive transitions are sensed that reel after this point, an error signal will issue indicating that the reel moved after it was supposed to have stopped.

The Reel Monitor routine then proceeds to step B9, in which the value of register TEMP1 (which contains the number of Reel (N)) is incremented by one, corresponding to the number of the next reel to be monitored. At step B10, the program tests to see if the contents of TEMP1 are less than three, and if so, it branches back to step B2, to repeat steps B2 through B10 for the next successive reel. If the value of TEMP1 is equal to three, indicating that the stopping solenoid 65 of the third reel has just been turned off, the program proceeds to step B11, where it loops until the last reel spin flag (the bit of RLSPNF corresponding to Reel (2)) has cleared during an Interrupt routine. The program then proceeds to step B12, at which a delay of approximately 88 milliseconds is processed to insure that the last reel has stopped moving. The program then proceeds to step B13, at which the Check Transitions subroutine is called for the last reel. When the program returns from the Check Transitions subroutine, it returns to step Al of FIG. 9A, to proceed with processing of the non-reel spin states.

FIG. 9C illustrates the processing sequence of the Random Count subroutine which is called at step B3 of the Reel Monitor routine. At step C1, the Random Count subroutine accesses register RN(N), which contains the random number which was generated for Reel (N) at step A6 of FIG. 9A. This random number is then stored in general purpose register TEMP2, which will be used as the "aggregate number counter" for Reel (N) during the Random Count subroutine. It will be recalled that the random number for Reel (0) is selected in the range of 32 to 63, and the random numbers for Reels (1) and (2) are selected in the range of 6 to 11. The program then proceeds to step C2 where it loops until the next Serial I/O Interrupt is completed. At step C3, after completion of an I/O Interrupt has been detected, the program accesses register NUFLD (new field) and determines whether the Reel (N) bit of that register is set. NUFLD is an eight bit register in internal RAM having one bit, or "new field flag," allocated to each reel. During each Reel Control Interrupt, the microprocessor determines whether the field state of any reel has undergone a positive transition, and if so, sets that reel's corresponding flag in NUFLD for use during the Random Count subroutine. If it is determined at step C3 that the Reel (N) flag of NUFLD is not set, the program returns to step C2 and loops between steps C2 and C3 until it determines that the Reel (N) flag of NUFLD is set. It then proceeds to step C4, at which all new field flags in register NUFLD are cleared. At step C5, the random number of Reel (N) is counted down by decrementing the contents of register TEMP2 by one. Thus, register TEMP2 keeps track of the aggregate number of fields of Reel (N) that have passed its sensor 25 since the start of the Random Count subroutine.

At step C6, the microprocessor determines whether the number stored in TEMP2 is equal to zero, and if not, returns to step C2. The program then loops between steps C2 to C6 until TEMP2 equals zero, at which point Reel (N) will have rotated through a number of fields equal to the random number stored in its respective register RN(N). The program then proceeds to step C7, at which Reel (N)'s stopping solenoid 65 is fired. More specifically, the microprocessor accesses register DOUTB1 and sets the Reel (N) bit of that register. It then transmits the new value of DOUTB1 to microprocessor terminals D0 to D7, issues the three bit code corresponding to first direct output circuit 117 to terminals A4 to A6, and pulses write terminal WR. Read/-Write Logic 107 then transmits pulse LDO1 which latches the new value of DOUTB1 to first direct output circuit 117 via databus 95, causing the STOP SPIN signal to be sent to the stopping solenoid 65 of Reel (N). At step C8, register SONTMR (solenoid on timer) is loaded with the binary equivalent of decimal number 14. SONTIM is an eight bit internal RAM register which is used during the interrupt routines to time the duration of the STOP SOLENOID signal, which energizes the appropriate stopping solenoid 65 for a period of seven milliseconds. After SONTMR has been loaded, the program leaves the Random Count subroutine and returns to step B3 of the Reel Monitor routine from which it was called.

FIG. 9D is a flow chart of the Check Transitions subroutine which is called from the Reel Monitor routine at steps B7 and B13. At step D1 of the Check Transitions subroutine, the microprocessor tests the Reel (N−1) bit of register XTRATR, to determine if the track of that reel has made a single positive transition since the reel's stopping solenoid 65 was fired. It will be recalled that XTRATR was cleared at step A3 of the main program, in conjunction with the enablement of "soft error" processing. Thereafter, so long as soft error processing is in effect (as determined by register SOFTEN), a one bit extra transition flag corresponding to a given reel is set in XTRATR during an Interrupt routine if that reel's sensor 25 detects a positive track state transition after its stopping solenoid 65 has been fired. If a second positive transition is detected, an error signal indicating improper reel movement is sent. However, if only one positive transition is detected during soft error processing, the microprocessor does not issue an error signal since, as discussed above, the transition may be a "false" positive transition. In this case, the Check Transition subroutine is used to determine whether a true or false positive transition has occurred and to set the reel's position counter accordingly.

Since the microprocessor processes instructions at an extremely high rate of speed compared to the rotational speed of the reels, the Check Transitions subroutine cannot be performed for a given reel immediately after that reel's stopping solenoid has been fired, as the reel may not yet have settled into its final stopping position. Accordingly, after the stopping solenoid 65 for Reel (N) has been fired (at step C7 of Random Count), the Check Transitions subroutine tests Reel (N−1), which settled into its final stopping position while Reel (N) was spinning. If Reel (N) is the first reel 2A (N=0), or if the Reel (N−1) extra transition flag is not set, the program r to the step of the Reel Monitor routine from which the Check Transitions subroutine was called (either step B7 or B13). Otherwise, the program proceeds to step D2. At step D2, the extra transition flag of Reel (N−1) in register XTRATR is cleared. Since Reel (N−1) is now stopped, any subsequent setting of its extra transition flag will indicate improper reel movement and cause an error signal to be generated.

As discussed above in conjunction with step A3 of FIG. 9A, if the signal to fire stopping solenoid 65 of a given reel is sent at the start of an odd field pattern (narrow slot/wide bar), and the extra transition flag of that reel is subsequently set, the microprocessor may conclude that a "true" positive transition has occurred, and that the sprocket 9 has skipped to the next rotational position beyond that stored in the reel's position counter. Accordingly, steps D3 to D6 are used to test whether the field number stored in RL(N−1)POS has an odd or even field pattern and thus determine whether the positive transition noted at step D1 was true or false.

Since field F30 is the only even numbered field having an odd field pattern, the program tests to see if the field number stored in register RL(N−1)POS is equal to 30 at step D3. More specifically the number is transmitted to the accumulator of microprocessor 89, which is then tested to determine if its contents equal thirty. If so, the microprocessor converts this number to an odd number at step D4 by complementing the accumulator, and proceeds to step D5. If not, then the pattern of the field number in RL(N−1)POS is consistent with the even or odd state of its contents, and the program may proceed directly to step D5. At step D5, the microprocessor tests to see if the contents of RL(N−1)POS are even or odd, by dividing the contents of the by two (shifting all the bits to the right by one) and determining whether or not a "carry" bit was produced, indicating an odd number. If the field number was even, indicating that the stopping solenoid 65 of Reel (N−1) was fired on an even field pattern, the microprocessor must determine whether Reel (N-1) actually stopped at the field number in RL(N−1)POS, or whether it skipped to the next rotational pos The program thus proceeds to step D6 at which it is determined whether the sensor 25 of Reel (N−1) is presently indicating an odd or even field pattern. More specifically, microprocessor 89 accesses register LASTVAL which is loaded during each Reel Control Interrupt with the most recent value of the first direct input byte, comprising the states of reel phototransistors 75 and camshaft phototransistor 139. The bit in LASTVAL corresponding to the phototransistor 75 of Reel (N−1) may of RL(N−1)POS correspond to the actual stopping position of Reel (N−1).

When the positioning of a reel relative to its corresponding sensor 25 and pawl arm 31 is properly adjusted, the reel will arrive at its intended stopping position approximately 12 milliseconds after the last positive transition of its track state, in accordance with the 12 millisecond anticipated stop response time of its rotation governing module 27. Since the reel spins at a rate of 31.25 milliseconds per field (one revolution per second), this stopping position will be reached when the sensing zone 87 of sensor 25 is located at a point 12/31.25, or just over $\frac{1}{3}$ of a field width (11°15') p the start of the field which it crossed. Accordingly, if the reel is stopped on an even field pattern, sensing zone 87 will intersect a slot 69 of coding ring 19 (track state 1); if stopped on an odd field pattern, the sensing zone will intersect a bar 71 (track state 0).

Thus, if the microprocessor determines that RL(N−1)POS contains an even number other than 30 (at steps D3 and D5) and that the sensor 25 of Reel (N−1) is reading a track state of 1 (even field pattern as determined by testing the corresponding bit of LASTVAL at step D6, the positive transition detected at step D1 is determined to be a false transition, and the contents of RL(N−1)POS are left unchanged. The program then return step of the Reel Monitor routine from which it was called. However, if these determinations are not made, the program proceeds to step D7 at which the microprocessor increments the contents of RL by one. At step D8 it is determined whether the incremented value of RL(N−1)POS equals 32, and if not, the microprocessor transmits the contents of that register to RL(N−1)POS/C of external RAM 99, at step D9, to preserve contents in case of power interruption. If the new value equals 32, the microprocessor determines that the reel has stopped at F0, and clears RL(N−1)POS at step D10 before transmitting its contents RL(N−1)POS/C at step D9. The program then returns to the step of the reel monitor routine (B7 or B13) from which it was called.

Interrupt Routine

FIGS. 10A to 10E present flow charts of the abovementioned interrupt routine, which is called by microprocessor 89 every 250 microseconds, upon issuance of a periodic signal the microprocessor's internal interrupt clock. At step Al, the microprocessor stores various status conditions pertaining to the portion of the main program from which the Interrupt is being called, so that it will be able to continue processing the main program from the step where it left off, after the Interrupt routine is completed. At step A2, the microprocessor determines which type of interrupt will be performed during the present Interrupt routine, in accordance with the state of a serial I/O flag SIOF. SIOF is a single bit in a designated eight bit register of internal RAM, which is set during every other pass through the Interrupt routine. If it is set at step A2, the program performs a Serial I/O Interrupt, as discussed below with reference to FIG. 10E. If it is not set at step A2, the program- performs a Reel Control Interrupt, which begins at step A3. Accordingly, the Serial I/O and Reel Control Interrupt are each performed once every 500 microseconds.

At step A3, after determining that SIOF is not set, the microprocessor sets it so that the next Interrupt routine will perform a Serial I/O Interrupt. At step A4, the latest sampling of reel and camshaft phototransistors 75 and 139 is transferred from register DINB1/C (direct input byte, in CMOS) in external CMOS RAM 99 and transmitted to general purpose register TEMP3 in microprocessor 89. DINB1/C is updated during every Serial I/O Interrupt to reflect the latest value of the inputs to first direct input circuit 113.

At step A5, the microprocessor determines which reels, if any, have made a positive or negative field state transition since the last Reel Control Interrupt. More specifically, the contents of register LASTVAL, which contains the value of register DINB1/C from the last Reel Control Interrupt, is transferred to the microprocessor's accumulator and exclusively OR'd with the contents of TEMP3 (new samples) so that only those bits of TEMP3 which have changed since the last Reel Control Interrupt will be set. The result is then stored in register TEMP4, and the program proceeds to step A6, in which the new optic samples of register TEMP3 are stored in LASTVAL, replacing the previous byte of optic samples.

At step A7, the microprocessor determines which of the sample transitions from step A5 were positive (low to high) transitions, by performing a logical AND operation between the contents of registers TEMP3 (new optic samples) and TEMP1 (sample transitions). The results of this operation are then stored in register TEMP3, replacing the new optic sample information which was stored in LASTVAL at step A6. At step A8, the microprocessor sets a single transition flag for each reel which has made a positive transition in register SGLTRF (single transition flag), to indicate that each reel has begun to move. SGLTRF is an eight bit register in internal RAM having a bit, or "single transition flag," corresponding to each reel. This register will be used in conjunction with the Reel (N) Slow routine, which will be discussed in conjunction with FIG. 10D.

At step A9, the program tests TEMP3 (positive transitions) to see if the bit corresponding to camshaft phototransistor 139 is set, indicating that the edge of finger 66 in camshaft positioning disc 68 has just passed sensor 64, and that the camshaft 50 has thus finished one revolution. If so, the program proceeds to step A10, at which the cocking motor bit of DOUTB1 is cleared, and the new value of DOUTB1 is latched into first direct output circuit 117, turning off cocking motor 52. If not, the program branches around step A10 and goes directly to step A11. At step All of the Reel Control Interrupt, the microprocessor tests register RLSTRT to see if any reels should be kicked. If not, the program branches to step A16, discussed below. It will be recalled that FLSTRT is an 8-bit register in internal RAM having a bit, or "reel start flag," corresponding to each of the three reels of the amusement machine. These flags are tested at step All of the Interrupt routine, and if any are set, the microprocessor proceeds to step A12, in which the/corresponding starting solenoids 53 are fired. For example, all three reel start flags are set at step A4 of the main program when handle 83 is pulled. In this case, the microprocessor would proceed to step A12 during the following Reel Control Interrupt and fire all three starting solenoids 53 by setting the three designated bits of register SOUTB1 used to control energization of the three corresponding starting solenoids 53. At the end of the next serial I/O cycle, START SPIN signals 1, 2 and 3 would be sent from driver circuit 131 to their three respective stopping solenoids 65, causing their associated pawl arms 31 to kick reels 2A, 2B and 2C.

It will be appreciated that all three reels need not be kicked at step A12. For example, if a tilt condition occurred while some reels were spinning but after others had stopped, it may be desirable not to rekick the stopped reels after the tilt condition has been cleared, especially if the reels that had stopped are displaying winning indicia 8. In this instance, the microprocessor may be programmed so that, when the tilt is cleared, (as by a serviceperson opening and closing a door for accessing the machine's interior) only those reel start flags corresponding to the reels which were spinning when the tilt condition occurred would be set, in accordance with the state of register DONE/C (set at step B6 of the Reel Monitor routine, FIG. 9B).

At step A13, the reel spin flags of RLSPNF, corresponding to the reels that were kicked in step A11, are set. These flags will stay set until the stop solenoids of their corresponding reels have been fired in a later Interrupt routine.

At step A14, register RLSTRT, which was set at step A4 in the main program (FIG. 9A) to enable reel kicking, is cleared. Register SONTMR is then loaded at step A15 with the binary equivalent of decimal number 14, which will be counted down in the Reel Control Interrupts at 500 microsecond intervals, to provide a solenoid on-time of 7 milliseconds. The program then proceeds to step A16.

At step A16, the microprocessor tests register SOUTB1 to see if any start solenoids 53 are presently energized. If SOUTB1 is clear (indicating no start solenoids are energized), the program branches to step A20. If not, the contents of SONTMR are decremented by one at step A17 and the program proceeds to step A18, at which the microprocessor tests to see if the new contents equal zero. If so, the microprocessor accesses SOUTB1 at step A19 and clears the bits which control the START SPIN signals of serial output driver 131, causing the start solenoids 53 to be deenergized after the following I/O cycle is finished. The program then proceeds to step A20. Alternatively, if the contents of SONTMR at step A18 were not equal to zero, the program would branch directly to step A20.

At step A20, the microprocessor tests DOUTB1 to see if any of the three bits corresponding to stopping solenoids 65 are set. If not, the microprocessor determines that no stopping solenoids are energized and branches to step A26. Otherwise, the program proceeds to steps A21 and A22, at which the microprocessor decrements solenoid timer SONTMR by 1 and branches to step A26 if the new value of SONTMR does not equal zero. If SONTMR equals zero, the microprocessor determines that the energized stopping solenoid should be turned off, and carries out steps A23 to A25.

At step A23, register RLSPNF is accessed and the reel spin flag of the reel whose stopping solenoid is energized (i.e., whose DOUTB1 bit is set), is cleared to indicate that the reel has been stopped. At step A24, microprocessor 89 turns off the energized stop solenoid 65 by clearing the corresponding bit of DOUTB1 and transmitting the new contents of that register to first direct out-put circuit 117. It then transmits the new contents of DOUTB1 to DOUTB1/C at step A25, to preserve the state of the first direct output byte in case of a power interruption.

At step A26, the microprocessor accesses NUFLD and sets the new field flag of each reel that has made a positive transition. More specifically, the contents of TEMP3 (positive sample transitions) are logically OR'd with NUFLD, so that the new field flags which were previously set remain set, and those that were not are now set if their corresponding reel made a positive field state transition since the last Reel Control Interrupt. NUFLD may now be used during the main program in the Random Count subroutine, to determine when each reel makes a positive field state transition.

The program now proceeds to steps A27, A28, and A29, in which the Reel (0) Test, Reel (1) Test and Reel (2) Test routines are sequentially performed, as discussed in detail below. At step A30, the microprocessor status conditions that were stored at step A1 of the Interrupt routine are retrieved, so that the microprocessor can continue processing the main program from the point at which the Interrupt routine was called. The Interrupt routine of FIG. 10A is then completed, and the microprocessor returns to the main program.

Reel (N) Test Routine

FIG. 10B illustrates the processing steps of the Reel (0) Test, Reel (1) Test, and Reel (2) Test routines of steps A27–A29 in the Interrupt routine. Since the three Reel Test routines involve substantially the same processing steps, FIG. 10B (and related FIGS. 10C and 10D) refer to a single, illustrative routine entitled "Reel (N) Test." Accordingly, at Interrupt routine step A27, the steps of FIG. 10B are performed with N=0 (first reel, 2A); at step A28 with N=1 (reel 2B); an at step A29 with N=2 (reel 2C). For ease of description, the following discussion of the Reel (N) Test routine will relate to Interrupt routine step A27, in which N=0.

At step B1, the microprocessor tests RLSPNF to see if the reel spin flag of Reel (0) is set, indicating that Reel (0) is, or should be, spinning. If the flag is not set, the program proceeds to the No Spin routine, discussed below. If it is set, the microprocessor tests to see if a positive or negative transition occurred in the most recent optic sample of Reel (0)'s phototransistor 75. More specifically, register TEMP4 (sample transitions—see step A5, FIG. 10A) is accessed, and the Reel (0) bit is tested; if clear, the program proceeds to step B3, in which an 8-bit register SAMCTR(0) (sample counter for Reel (0)) in internal RAM is incremented by one. SAMCTR(0) stores the number of optic samples of Reel (0)'s phototransistor 75 since the last field state transition of that reel was detected. Accordingly, it is incremented at step B3, and cleared each time a positive or negative optic sample transition is detected, as discussed below. At step B4, the microprocessor determines whether the contents of SAMCTR(0) equal 0, indicating that $2^8$ optic samples have been counted since the last transition. If so, the reel is turning too slowly, and the program branches to the Reel (N) Slow routine discussed below. If not, the Reel (0) Test routine is finished, and the program proceeds to Interrupt routine step A28.

Returning to step B2, if an optic sample transition is detected for Reel (0), the program proceeds to step B5, at which it is determined whether the transition was positive or negative. Register TEMP3 (positive transitions) is accessed and, if the bit corresponding to Reel (0) is clear (indicating the transition was negative), the microprocessor transmits the contents of SAMCTR(0) to 8-bit register SEG1R(0) (first segment of Reel (0)) of internal RAM at step B6. SEG1R(0) stores the number of Reel (0) optic samples counted while the first segment of each field 79 crossed the phototransistor 75 of that reel, for use in subsequent Reel (0) Test routines. SAMCTR(0) is then cleared at step B7 to complete the Reel (0) Test routine, and the program proceeds to Interrupt routine step A28.

If a positive optic sample transition is detected at step B5, the program proceeds to step B8 at which the microprocessor tests the SPINIT flag to see if spin initialization is in process. As discussed above with reference to FIG. 9A, step A5, spin initialization provides a brief delay before the microprocessor's rotation testing functions (direction, speed, and acceleration) are performed, thus allowing the reels to reach a constant rotational speed without generating an error signal. If SPINIT is set, the program branches to step B17; if not, the microprocessor proceeds to step B9, at which a test for reverse reel rotation is begun.

At step B9, the microprocessor determines whether the last field past sensor 25 of Reel (0) contained an odd or even field pattern, by comparing the contents of SAMCTR(0) to those of SEG1R(0). SAMCTR(0) now contains the number of samples counted during the last field's second segment or "second segment count," and SEG1R(0) contains the number of samples counted during that field's first segment, or "first segment count." If the first segment count is less than or equal to the second, the microprocessor determines that the last field pattern was odd (wide slot/narrow bar), based on an assumption of correct rotational direction, and proceeds to step B10. The second segment count is now divided by two in the accumulator to create a modified second segment count. At step B11, the modified second segment count is compared to the first segment count, to determine whether the reel is spinning in the correct rotational direction. Since the width of the second segment of an odd field pattern is more than three times that of the first segment, the modified second segment count should still be greater than the first segment count, in which case the microprocessor will determine that Reel (0) is still spinning in the correct rotational direction, and proceed to step B17. However, if the reel is spinning in the wrong direction (counterclockwise with respect to FIG. 5), the widths of the two segments corresponding to registers SAMCTR(0) and SEG1R(0) will be equal, so their respective segment counts will be sufficiently close to fail the test of step B11 if the reel speed and acceleration are otherwise within acceptable limits, as determined in the following steps of the Reel (0) Test routine. In this case, the program branches to step B12, in which a Reel (0) Reverse Error code is loaded into the microprocessor's accumulator, and then proceeds to step B13, at which the microprocessor tests to see if a tilt (from another source of error) is already in progress. If not, the program branches to a Process Tilt routine at step B14, in which control circuit 29 sends a REEL (0) REVERSE error signal to a device, such as a memory register or LED, which may be checked by a service person to determine the cause of the tilt condition. If a tilt is already in progress at step B13, the Reel (0) Test routine ends, and the program proceeds to Interrupt routine step A28, at which the Reel (1) Test routine is performed.

If the second segment count had been less than the first segment count at step B9, the microprocessor would determine that the last field pattern was even (wide slot/narrow bar), based on an assumption of correct rotational direction, and proceed to steps B15 and B16. Steps B15 and B16 are the counterparts of B10 and B11 for even field patterns, in which the microprocessor tests for proper rotational direction. The first segment count is divided by two in the accumulator and then compared to the second segment count. If the modified first segment count is greater, the program proceeds to step B17; if not, it branches to steps B12 to B14, at which the Reel (0) Reverse Error code is loaded and processed as discussed above.

At step B17, the first and second segment counts in SAMCTR(0) and SEG1R(0) are added in the accumulator to determine the total number of samples that were counted while the last field passed sensor 25 ("new field count"). At step B18, the new field count is divided by two, by rotating the contents of the accumulator to the right by one, and is then exchanged for the contents of eight bit register FLDCNT(0) (Field Count for Reel (0)) at step B19. The modified new field count is now stored in FLDCNT(0), and the "modified old field count" which preceded it is now in the accumulator.

At step B20, the microprocessor again determines whether spin initialization is in process, by testing SPINIT; if so, the program branches to step B32; if not, it proceeds to step B21, at which the test for proper reel speed is begun. The modified old field count stored in the accumulator is compared to a "minimum speed" constant equal to decimal number 45. If the modified old field count is greater than 45, this indicates that the corresponding field took over 90 samples (or 45 milliseconds) to pass sensor 25, and the reel is therefore spinning too slowly. If not, the program proceeds to step B22, at which the microprocessor determines whether the modified old field count is greater than a "maximum speed" constant of 25. If so, the reel is spinning at a rotational speed which is within acceptable limits, and the program proceeds to step B24. If not, this indicates the corresponding field took less than 50 samples, or 25 milliseconds, to pass sensor 25; accordingly, the reel is spinning too fast. If step B21 or B22 indicates that the reel is spinning too slow or too fast, the program branches to step B23, at which a Reel (0) Speed Error code is loaded in the accumulator. It then proceeds to step B13, discussed above, to determine whether a tilt is in progress. If so, the Reel (0) Test routine is finished. If not, the program proceeds to step B14 to process a tilt routine in which a Reel (0) Speed Error code is used to indicate that the tilt was caused by a speed error on Reel (0).

At step B24, the microprocessor begins a test for improper reel acceleration by subtracting the modified new field count in register FLDCNT(0) from the modified old field count in the accumulator. At step B25, it determines whether the difference is positive (new field count less than or equal to old field count) or negative. If the difference is positive, indicating that the reel is accelerating or maintaining constant speed, the program proceeds to step B26 at which a "maximum acceleration" constant equal to decimal number 8 is subtracted from the modified field count difference, creating an "acceleration difference" which is tested at step B27. If the acceleration difference is negative, this indicates that the difference between the last two field counts is less than 16, and the reel's acceleration is therefore within acceptable limits. The program then proceeds to step B32. On the other hand, if the acceleration difference is greater than or equal to zero at step B27, this indicates a difference of 16 or more samples between the last two field counts, which is beyond the acceptable acceleration limit. The program then proceeds to step B28, at which a Reel (0) Acceleration Error code is loaded in the accumulator. The microprocessor then proceeds to step B13, and, if a tilt is in progress, ends the Reel (0) Test routine. If not, a tilt is processed at step B14, in which the microprocessor indicates that the tilt was caused by excessive acceleration of Reel (0).

If a negative modified field count difference had been determined at step B25, this would indicate that Reel (0) was decelerating and the program would then branch to steps B29 to B31 to determine whether the deceleration was within acceptable limits. At step B29, the absolute value of the modified field count difference is obtained by complementing the accumulator's content. A "maximum deceleration" constant equal to decimal number 8 is then subtracted from this number to provide a "deceleration difference." At step B30, the microprocessor determines whether the deceleration difference is negative and if so, proceeds to step B32. If the deceleration difference is positive or equal to zero, this indicates a difference of at least 16 samples between the old and new field counts, which is beyond the acceptable deceleration limits. Accordingly, the program proceeds to step B31 at which a Reel (0) Deceleration Error code is loaded in the accumulator. The microprocessor then proceeds to step B13 to determine if a tilt is already in progress. If so, the Reel (0) Test routine is complete; if not, the microprocessor proceeds to step B14 and processes a tilt in which it is indicated that the cause of the tilt was a deceleration error on Reel (0).

If the microprocessor arrives at step B32, Reel (0) is deemed to be properly rotating, and the microprocessor proceeds to update its position counter RL(0)POS. At step B32, the microprocessor determines whether the modified new field count stored in register FLDCNT(0) is less than the second segment count stored in SAMCTR(0). Since the modified new field count is equal to one-half the total new field count, a negative determination at step B32 indicates that the new field pattern is even, and the program proceeds to step B33 at which the number 3 is loaded in an eight bit internal RAM register SYNCTR(0) (Synch Counter for Reel (0)). The microprocessor then increments position counter RL(0)POS by one at step B34, and proceeds to step B38.

If the modified new field count had been less than the second segment count at step B32, the microprocessor would conclude that the new field pattern was odd and would then decrement the synch counter SYNCTR(0) by one at step B35. At step B36 it is determined if the contents of SYNCTR(0) are equal to zero. If not, it is concluded that the new field was not F31 and the program proceeds to step B30 to increment position counter RL(0)POS. If SYNCTR0 equals zero at step B36, this indicates that three successive odd field patterns have passed, and the new field (i.e., the last field past Reel (0)'s sensor 25) was therefore F31. Accordingly, the program proceeds to step B37, in which position counter RL(0)POS is cleared, and then to step B38. Sample counter SAMCTR(0) is then cleared so that the next Reel Control Interrupt will begin counting the number of samples in field F0, and the Reel (0) Test routine ends. The program now proceeds to step A28, in which the Reel (1) Test routine is performed with respect to reel 2B.

Figure 10C:
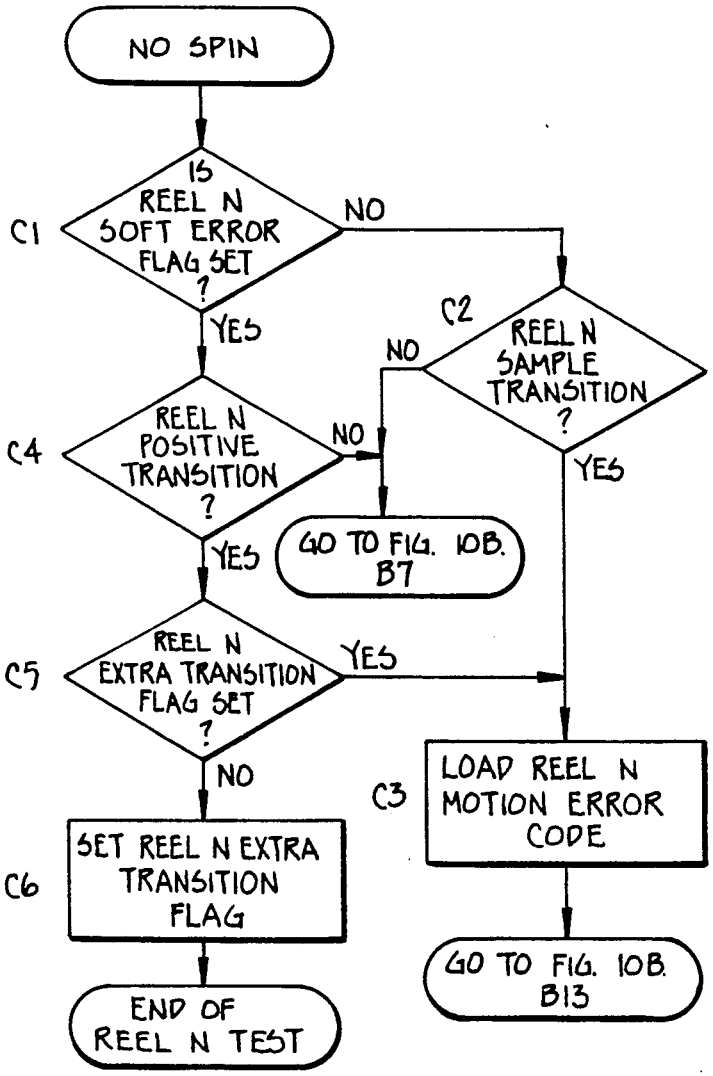

FIG. 10C illustrates the No Spin routine to which the Reel (N) Test routine branches if the reel spin flag of Reel (N) is not set at step B1 of FIG. 10B. To simplify the following discussion, FIG. 10C will be described with reference to Reel (0), consistent with the above description of the Reel (0) Test routine.

The No Spin routine of FIG. 10C is performed after a determination, at step B1 of the Reel (0) Test routine, that the reel spin flag of Reel (0) is not set, indicating that the energization of Reel (0)'s stopping solenoid 65 has ended; thus, the reel is not, or should not be moving. At step C1, the microprocessor determines whether the soft error flag for Reel (0) is set in register SOFTEN. If not, Reel (0) should not be moving at all, and any sample transitions on that reel's phototransistor 75 would indicate improper reel motion. Accordingly, the program tests register TEMP4 (positive or negative sample transitions) at step C2. If the bit corresponding to Reel (0) is set, indicating that a sample transition has occurred, the microprocessor loads a Reel (0) Motion Error code in the accumulator at step C3, and proceeds to step B13 of the Reel (N) Test routine. It then determines if a tilt is already in progress, and if not, processes a tilt operation in which it is indicated that improper motion occurred on Reel (0) after it stopped. Alternatively, if the Reel (0) bit of TEMP4 had been clear at step C2, this would indicate that no improper motion had been detected on Reel (0), and the program would then proceed to step B7, to clear SAMCTR(0) and end the Reel (0) Test routine.

If the Reel (0) soft error flag had been set at step C1, this would indicate that soft error processing was still in effect after deenergizing the stopping solenoid 65 of Reel (0), so the reel should either be stopped or about to stop. As discussed above, it is possible to sense a "false" positive sample transition during this period, even though the reel is about to settle in the intended stopping position. The microprocessor therefore tests TEMP3 (positive transitions) at step C4 to determine if a positive sample transition has been detected by Reel (0)'s sensor 25. If not, the program proceeds to step B7 of FIG. 10B, at which SAMCTR(0) is cleared before the Reel (0) Test routine ends. However, if the Reel (0) bit of TEMP3 is set, the microprocessor tests XTRATR at step C5 to see if the extra transition flag of Reel (0) is set, indicating that this is the second positive transition detected since the stopping solenoid 65 of Reel (0) was fired. If so, the program branches to step C3, loads the Reel (0) Motion Error code in the accumulator, and proceeds to step B13 of the Reel (0) Test routine discussed above. If the Reel (0) extra transition flag is clear at step C5, indicating this is the first positive transition detected since the stopping solenoid 65 of Reel (0) was fired, the microprocessor sets the Reel (0) extra transition flag of register XTRATR at step C6 to complete the Reel (0) Test routine. The program then proceeds to Interrupt routine step A28, to start the Reel (1) Test routine.

Figure 10E:
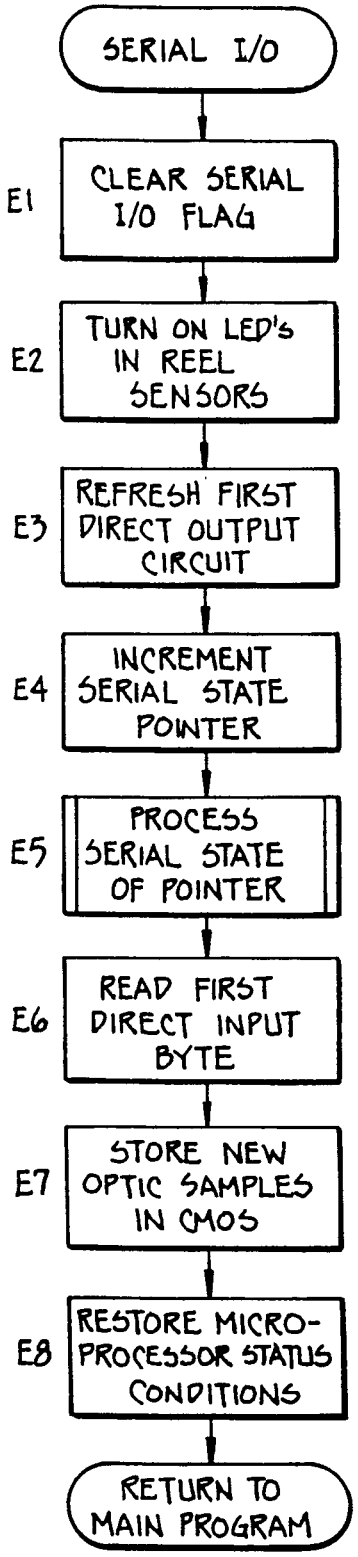
Figure 10D:
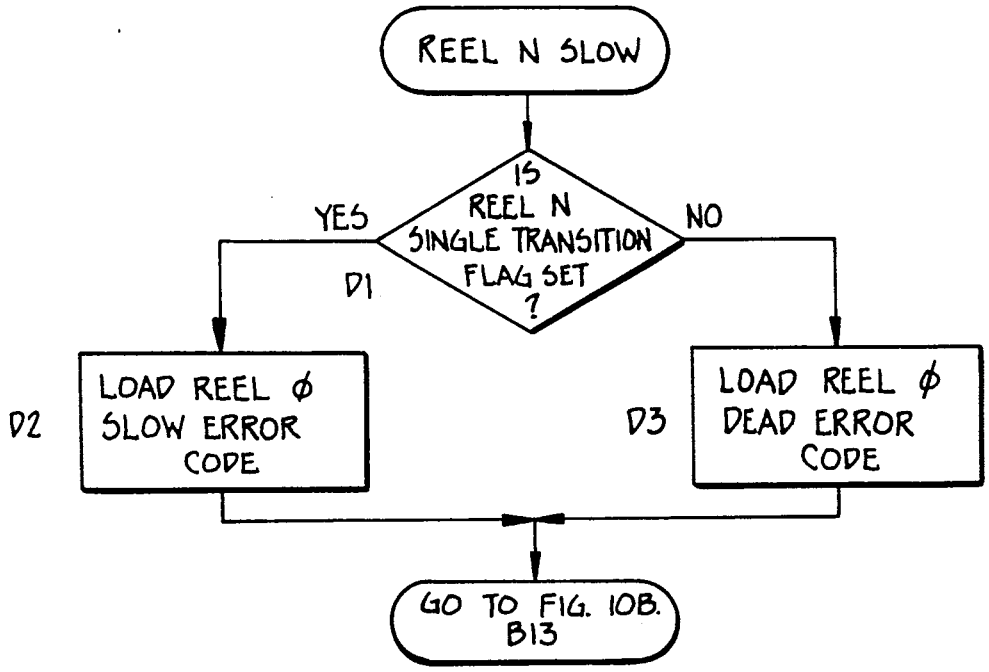

FIG. 10D is a flow chart of the Reel (N) Slow routine, to which the Reel (N) Test routine branches at step B4 (FIG. 10B) if the microprocessor has counted $2^8$ samples of Reel (0) with no transitions. In this case, Reel (0) has either failed to spin after its starting solenoid 53 was fired (as when start spring 37 is broken), or began spinning and was abruptly slowed down or stopped.

At step D1, the microprocessor tests the single transition flag corresponding to Reel (0) in SGLTRF, to determine whether that reel ever moved after it was kicked. If it did, a Reel (0) Slow Error code is loaded in the accumulator at step D2 to indicate that the reel began moving and then abruptly slowed down. If Reel (0) never moved, its single transition flag would be clear at step D1 and the microprocessor would load a Reel (0) Dead Error code in the accumulator at step D3. After the appropriate error code is loaded in the accumulator at step D2 or D3, the microprocessor proceeds to step B13 of the Reel (0) Test routine at which it determines whether a tilt is already in progress. If not, the program branches to the Process Tilt routine at step B14, in which an error signal corresponding to the appropriate error code is sent to a corresponding device for indicating the cause of the tilt condition. If a tilt is already in progress at step B13, the Reel (0) Test routine ends and the program proceeds to Interrupt routine step A28, at which the Reel (1) Test routine is performed.

FIG. 10E is a flow chart of the processing steps performed in the Serial I/O Interrupt which is performed if the serial I/O flag SIOF is set at step A2 of the Interrupt routine. At step E1, the serial I/O flag SIOF is cleared, so that a Serial I/O Interrupt will not be performed during the next Interrupt routine. By clearing this flag at step E1, and setting it at step A3 of the interrupt routine, the microprocessor is programmed to perform a Serial I/O Interrupt during every other Interrupt routine, or once every 500 microseconds.

At step E2, the microprocessor turns on LEDs 73 in reel sensors 25 by writing a byte of data to second direct output latch 153 (as discussed above in conjunction with FIG. 8) in which the bits corresponding to the three reels are set. In order to allow sufficient time for the LEDs 73 to reach optimum brightness, it is preferable to wait approximate 90 microseconds after the LEDs have been turned on before sampling their corresponding phototransistors 75. The Serial I/O Interrupt is therefore preferably designed to process 90 microseconds or more of program instructions before the microprocessor reads the first direct input byte.

At step E3, the first direct output byte is refreshed by reading the contents of register DOUTB1 into the first direct output latch 109. If the bit of DOUTB1 corresponding to cocking motor 52 was previously set at step A8 of the main program, this Serial I/O Interrupt will supply power to the cocking motor at step E3, while the respective states of stopping solenoids 65, which form the remainder of the first direct output byte, are refreshed.

At step E4, the microprocessor accesses an eight bit, general purpose register TEMP5 in internal RAM, and increments the value of a serial state "pointer" which it contains. Since six Serial I/O Interrupts are performed in each serial I/O cycle, the microprocessor must carry out a different "serial state" during each such interrupt so as to receive and transmit the appropriate bytes of serial input and output data and perform necessary processing operations with this data before storing it. Accordingly, register TEMP5 is used to indicate which one of these six serial states is to be performed during any given Serial I/O Interrupt.

At step E5, the program shifts to the serial state which is pointed to by register TEMP5 and performs the processing operations required by that serial state. During the first serial state, step E5 is initiated by latching serial input and output shift registers 121 and 127 so as to sample the twenty-four serial inputs and provide new data to the forty-eight serial outputs. During each serial state, the microprocessor writes a byte of serial output from the appropriate one of registers SOUTB1 to SOUTB6 into serial output buffer 125, and resets the serial clock by instructing Read/Write Logic 127 to send signal ESIB. In addition, during each of the second, third and fourth serial states, a byte of serial input data is read from serial input buffer 123 into the appropriate one of registers SINB1 to SINB3 after signal ESIB is sent, as discussed above in conjunction with FIG. 8. During the last serial state, the "pointer" in TEMP5 is cleared so that the Serial I/O cycle will be repeated.

At step E6, the microprocessor reads the byte of data from first direct input buffer 143 into its accumulator, to obtain a new sampling of the states of reel phototransistors 75 and camshaft phototransistor 139. It will be understood that the LED 165 opposite camshaft phototransistor 139 need not be pulsed in the same manner as reel LEDs 73, since the sampling of positioning disc 68 is not as critical as that of coding ring 19. LED 165 may therefore be connected to a constant source of power, for simplicity.

At step E7, the new optic samples which were read into the accumulator at step E6 are stored in register DINB1/C of external RAM 99, to be used during the following Reel Control Interrupt. The program then proceeds to step E8, at which the microprocessor status conditions that were stored at step A1 of the Interrupt routine are retrieved so that the microprocessor can continue carrying out the main program from the point at which the Interrupt routine was called. The Interrupt routine of FIG. 10A is then completed and the microprocessor returns to the main program.

From the above description, it will be apparent that the subject matter of this invention is capable of taking various useful forms, and it is intended, therefore, that this disclosure be taken in an exemplary sense and the scope of protection afforded be determined by the appended claims.

We claim:

1. An amusement machine comprising:

a reel mounted in a frame for rotation about an axis, the reel having a plurality of indicia disposed thereabout;

said reel comprising a single track positioned on a circumferential path about said axis, for monitoring the rotational position of the reel relative to a fixed reference point;

said track comprising a plurality of fields corresponding to said plurality of indicia, each field spanning a unique arcuate path at a fixed radial distance from said axis;

a sensor positioned so as to directly detect movement of said fields past a single point at said fixed radial distance;

means responsive to said sensor for detecting the passage of a home field; and reel position counting means for directly counting the number of fields that pass the sensor after said home field.

2. An amusement machine according to claim 1 further comprising:

a plurality of additional reels, each having a corresponding sensor, detecting means and reel position mounting means;

means responsive to manual user input for spinning said reels;

means for independently stopping the rotation of each reel at a stopping position in response to the output of its corresponding sensor after permitting each reel to spin through its respective home field at least once;

means responsive to said plurality of reel position counting means for determining the stopping position of each reel relative to a corresponding fixed reference point and for assigning a predetermined game value to the sequence of said plurality of reel stopping positions; and means responsive to said assigning means for providing a user perceivable indication of said assigned value.

3. An amusement machine according to claim 2 wherein said indication providing means comprises means for dispensing a quantity of coins having a monetary value according to said assigned value.

4. An amusement machine as in claim 1, wherein said sensor cooperates with said track to output a pattern of signals corresponding to a forward reel rotational direction and a different pattern of signals corresponding to a reverse reel rotational direction, and further comprising:

means responsive to said sensor for providing a rotational direction error signal in response to one of said forward and reverse rotational patterns.

5. An amusement machine as in claim 4, wherein said track comprises sequential portions which are read by said sensor as one of a high and low state;

at least a portion of said track comprises a continuous array of said fields each having one high and one low state of different arcuate spans; and said error signaling means comprises means responsive to the passage of said array for sensing a predetermined change in state of said sensor output and comparing the durations of the following two states to determine the direction of reel rotation.

6. An amusement machine according to claim 5 wherein each field of said array has the same arcuate span;

said two states in each field of said array being arranged in either a first or a second order, with respect to the movement of said reel in a given rotational direction, said first order defined by a field having the shorter of its two states preceeding the longer one and said second order defined by a field having the longer of its two states preceding the shorter one; and wherein the sequence of said fields in said array alternates between the said first order fields and said second order fields.

7. An amusement machine as in claim 6 wherein the ratio of state span lengths in each field of said array is the same.

8. An amusement machine as in claim 7 wherein said duration comparing means comprises:

means for generating a periodic sampling pulse;

means responsive to said sensor output for counting the number of said pulses generated during the presence of each of said following two states;

means for comparing said two numbers corresponding to said two states and issuing said error signal if one of said numbers is not greater than the other of said numbers by more than a predetermined amount.

9. An amusement machine as in claim 8 wherein said ratio of state span lengths is greater than 2:1 and said duration comparing means further comprises:

means for storing two numbers in binary form;

means for determining which of said two numbers is greater than the other;

means for modifying the greater of said two numbers by performing a one bit shifting operation thereon; and means for comparing said modified number to said other number and issuing said error signal if the modified number is less than the other number.

10. An amusement machine as in claim 4 further comprising means responsive to said sensor for comparing the durations of two equal arcuate portions of said track as said reel rotates and generating an acceleration error signal if the duration of the first such arcuate portion is greater than the duration of the second such arcuate portion by more than a predetermined amount.

11. An amusement machine according to claim 10 wherein said duration comparing means comprises:

means for generating a periodic sampling pulse;

means responsive to said sensor output for counting the number of said pulses generated during the presence of each of said two arcuate portions to be compared; and means responsive to said counting means for generating said acceleration error signal if the second such number is less than the first such number by more than said predetermined amount.

12. An amusement machine according to claim 11 wherein each of said arcuate portions comprises one of said fields.

13. An amusement machine as in claim 4 further comprising means responsive to said sensor for comparing the durations of two equal arcuate portions of said track as said reel rotates and generating a deceleration error signal if the duration of the first such arcuate portion is less than the duration of the second such arcuate portion by more than a predetermined amount.

14. An amusement machine as in claim 13 wherein said duration comparing means comprises:

means for generating a periodic sampling pulse;

means responsive to said sensor output for counting the number of said pulses generated during the presence of each of said two arcuate portions to be compared; and means responsive to said counting means for generating said deceleration error signal if the second such number is greater than the first such number by more than said predetermined amount.

15. An amusement machine as in claim 14 wherein each of said arcuate portions comprises one of said fields.

16. An amusement machine as in claim 4 further comprising means responsive to said sensor for generating a slow speed error signal if the duration of a predetermined arcuate portion of said track as said reel rotates is greater than a first predetermined amount.

17. An amusement machine as in claim 16 further comprising means responsive to said sensor for generating a fast speed error signal if the duration of said arcuate portion is less than a second predetermined amount.

18. An amusement machine as in claim 17 further comprising:

means for generating a periodic sampling pulse;

means responsive to said sensor output for counting the number of said periodic pulses generated during the presence of said predetermined arcuate portion; and wherein said slow speed error signal generating means is responsive to said counting means for generating said slow speed error signal if said number of pulses is greater than said first predetermined amount; and said fast speed error signal generating means is responsive to said counting means for generating said fast speed error signal if said number of pulses is less than said second predetermined amount.

19. An amusement machine as in claim 18 wherein said arcuate portion comprises one of said fields.

20. An amusement machine as in claim 4 wherein said track comprises at least two equal arcuate portions, and further comprising:

means responsive to said sensor for generating an acceleration error signal if the duration of the first of said two equal arcuate portions as said reel rotates is greater than the duration of the second such arcuate portion by more than a predetermined acceleration error amount;

means responsive to said sensor for generating a deceleration error signal if the duration of the first of said two equal arcuate portions as said reel rotates is less than the duration of the second such arcuate portion by more than a predetermined deceleration error amount;

means for generating a slow speed error signal if the duration of at least one of said arcuate portions as said reel rotates is greater than a predetermined minimum speed amount; and means for generating a fast speed error signal if the duration of at least one of said arcuate portions as said reel rotates is less than a predetermined maximum speed amount.

21. An amusement machine as in claim 20 further comprising:

means for generating a periodic sampling pulse;

means responsive to said sensor output for counting the number of pulses generated during the presence of each of said two equal arcuate portions to be compared; and wherein said acceleration error signal generating means is responsive to said counting means for generating said acceleration error signal if the first such number is greater than the second such number by more than said acceleration error amount;

said deceleration error signal generating means is responsive to said counting means for generating said deceleration error signal if the first such number is less than the second such number by more than said deceleration error amount;

said slow speed error signal generating means is responsive to said counting means for generating said slow speed error signal if at least one of said two numbers is greater than said predetermined minimum speed amount; and said fast speed error signal generating means is responsive to said counting means for generating said fast speed error signal if at least one of said numbers is less than said predetermined maximum speed amount.

22. An amusement machine according to claim 21 wherein each of said arcuate portions comprises one of said fields.

23. An amusement machine as in claim 1 wherein said track comprises sequential patterns which are read by said sensors as one of a high and low state, each of said fields comprising one high and one low state of different durations;

said amusement machine further comprising:

means for categorizing each field in one of two categories based on whether the longer of two states precedes the shorter;

means for comparing the categorization of two adjacent fields to determine whether or not said adjacent fields are of the same category; and means for signaling passage of said home field based on the determination of said categorization comparing means.

24. An amusement machine according to claim 23 wherein said categorization of all but one of said fields alternates about the length of said track.

25. An amusement machine as in claim 1, further comprising:

means responsive to manual user input for spinning said reel;

means for timing the stopping position of said reel, after permitting it to spin through its home field at least once, comprising:

means for generating a random number greater than or equal to the number of indicia on said reel;

means responsive to said sensor and to said random number generating means for counting an aggregate number of fields past the sensor after said reel spin starts as determined by said random number;

means responsive to said aggregate number counting means for issuing a stop reel signal when said aggregate number counting means has counted said random number; and said amusement machine further comprising means for stopping said reel in response to said stop reel signal.

26. An amusement machine according to claim 25 wherein said reel is defined as a primary reel, and further comprising:

a plurality of secondary reels;

means responsive to said manual user input for spinning said secondary reels;

said reel stop timing means further comprising:

means for sequencing the stopping order for each of said primary and secondary reels in a predetermined sequence with said primary reel stopping first in said sequence;

means corresponding to each of said secondary reels for counting an aggregate number of fields past the sensor of its corresponding reel after the preceding reel of said predetermined sequence has been stopped;

means corresponding to each of said secondary reels for issuing a stop reel signal to its corresponding secondary reel when its corresponding aggregate number counting means has counted its corresponding aggregate number; and said amusement machine further comprising means corresponding to each of said secondary reels for stopping its corresponding reel in response to its corresponding stop reel signal.

27. An amusement machine as in claim 26 wherein said secondary random generating means generates a plurality of random numbers, each corresponding to one of said plurality of secondary reels, and each said secondary stop reel signal issuing means issues its stop reel signal when its corresponding aggregate number counting means has counted said corresponding said secondary random number.

28. An amusement machine as in claim 1 further comprising means responsive to said sensor for comparing the durations of two equal arcuate portions of said track as said reel, rotates and generating an acceleration error signal if the duration of the first such arcuate portion is greater than the duration of the second such arcuate portion by more than a predetermined amount.

29. An amusement machine according to claim 28 wherein said duration comparing means comprises:

means for generating a periodic sampling pulse;

means responsive to said sensor output for counting the number of said pulses generated during the presence of each of said two arcuate portions to be compared; and means responsive to said counting means for generating said acceleration error signal if the second such number is less than the first such number by more than said predetermined amount.

30. An amusement machine according to claim 29 wherein each of said arcuate portions comprises one of said fields.

31. An amusement machine as in claim 1 further comprising means responsive to said sensor for comparing the durations of two equal arcuate portions of said track as said reel rotates and generating a deceleration error signal if the duration of the first such arcuate portion is less than the duration of the second such arcuate portion by more than a predetermined amount.

32. An amusement machine as in claim 31 wherein said duration comparing means comprises:

means for generating a periodic sampling pulse;

means responsive to said sensor output for counting the number of said pulses generated during the presence of each of said two arcuate portions to be compared; and means responsive to said counting means for generating said deceleration error signal if the second such number is greater than the first such number by more than said predetermined amount.

33. An amusement machine as in claim 32 wherein each of said arcuate portions comprises one of said fields.

34. An amusement machine as in claim 1 further comprising means responsive to said sensor for generating a slow speed error signal if the duration of a predetermined arcuate portion of said track as said reel rotates is greater than a first predetermined amount.

35. An amusement machine as in claim 34 further comprising means responsive to said sensor for generating a fast speed error signal if the duration of said arcuate portion is less than a second predetermined amount.

36. An amusement machine as in claim 35 further comprising:

means for generating a periodic sampling pulse;

means responsive to said sensor output for counting the number of said periodic pulses generated during the presence of said predetermined arcuate portion; and wherein said slow speed error signal generating means is responsive to said counting means for generating said slow speed error signal if said number of pulses is greater than said first predetermined amount; and said fast speed error signal generating means is responsive to said counting means for generating said fast speed error signal if said number of pulses is less than said second predetermined amount.

37. An amusement machine as in claim 36 wherein said arcuate portion comprises one of said fields.

38. An amusement machine as in claim 1 wherein said track comprises at least two equal arcuate portions, and further comprising:

means responsive to said sensor for generating an acceleration error signal if the duration of the first of said two equal arcuate portions as said reel rotates is greater than the duration of the second such arcuate portion by more than a predetermined acceleration error amount;

means responsive to said sensor for generating a deceleration error signal if the duration of the first of said two equal arcuate portions as said reel rotates is less than the duration of the second such arcuate portion by more than a predetermined deceleration error amount;

means for generating a slow speed error signal if the duration of at least one of said arcuate portions as said reel rotates is greater than a predetermined minimum speed amount; and means for generating a fast speed error signal if the duration of at least one of said arcuate portions as said reel rotates is less than a predetermined maximum speed amount.

39. An amusement machine as in claim 38 further comprising:

means for generating a periodic sampling pulse;

means responsive to said sensor output for counting the number of pulses generated during the presence of each of said two equal arcuate portions to be compared; and wherein said acceleration error signal generating means is responsive to said counting means for generating said acceleration error signal if the first such number is greater than the second such number by more than said acceleration error amount;

said deceleration error signal generating means is responsive to said counting means for generating said deceleration error signal if the first such number is less than the second such number by more than said deceleration error amount;

said slow speed error: signal generating means is responsive to said counting means for generating said slow speed error signal if at least one of said two numbers is greater than said predetermined minimum speed amount; and said fast speed error signal generating means is responsive to said counting means for generating said fast speed error signal if at least one of said numbers is less than said predetermined maximum speed amount.

40. An amusement machine according to claim 39 wherein each of said arcuate portions comprises one of said fields.

41. An amusement machine as in claim 1, wherein said track comprises a plurality of light transmitting portions separated by a corresponding plurality of opaque portions disposed about said circumferential path at said fixed radial distance;

said sensor comprising:

light emitting means positioned adjacent said track on one side thereof, for illuminating said one side of said track in response to an electrical input; and photodetecting means for providing an electrical output in response to light from said light emitting means, positioned adjacent said track opposite said light emitting means such that said track alternately blocks and passes light from said light emitting means to said photodetecting means;

said amusement machine further comprising means for providing said electrical input to said light emitting means during rotation of said reel.

42. An amusement machine as in claim 41 wherein each of said fields comprises one of said light transmitting portions and-one of said opaque portions.

43. An amusement machine as in claim 42 wherein said track comprises a continuous array of said fields in a 360° circumferential path at said fixed radial distance.

44. An amusement machine as in claim 41 wherein said reel comprises a sprocket mounted for rotation therewith, said sprocket comprising:

a sprocket hub coaxially disposed on said reel;

a ring disposed at the outer periphery of said sprocket, having a plurality of sprocket teeth extending outwardly therefrom;

a plurality of generally radially extending spokes mounting said peripheral ring to said sprocket hub;

a disc mounted to said sprocket radially inward of said peripheral ring, said disc having a plurality of slots extending therethrough at said fixed radial distance, said slots being separated by opaque regions of said disc along said circumferential path, said disc being mounted with each of said sprocket spokes in registry with one of said opaque regions.

45. An amusement machine as in claim 1 wherein said sensor cooperates with said track to output a pattern of signals as said reel rotates, said track comprising sequential portions which are read by said sensor as one of a high and low state;

each of said fields comprises one each of said high and said low states;

said reel position counting means comprising means responsive to said sensor for changing said field number count in response to a predetermined change in state of said sensor output; and said home field detecting means comprising means responsive to the relative durations of said high and low states of said plurality of fields for detecting passage of said home field.

46. An amusement machine comprising:

a plurality of reels coaxially mounted in a frame for independent rotation about an axis, each having a plurality of indicia thereabout;

a like plurality of sensors each positioned adjacent a corresponding one of said reels;

means responsive to manual user input for spinning said reels;

each said reel comprising a region of coded data circumferentially arranged about said axis;

each of said sensors cooperating with said coded data of its corresponding reel to output a different pattern of signals for each of a forward and reverse rotational direction;

means responsive to each said sensor for providing a rotational direction error signal in response to detection of a predetermined one of said forward and reverse directional patterns;

means for independently stopping the rotation of each said reel at a stopping position in response to the output of its corresponding sensor;

reel position determining means responsive to said sensor for determining the stopping position of each reel relative to a corresponding fixed reference point;

means responsive to the sequence of said stopping positions of said plurality of reels for assigning a predetermined game value thereto; and means responsive to said assigning means for providing a user perceivable indication of said assigned value.

47. An amusement machine according to claim 46 wherein said region of each said reel comprises a single track of said coded data positioned on a circumferential path about said axis at a fixed radial distance therefrom, and each said sensor is adapted to detect movement of its corresponding track past a single point at said fixed radial distance, and to output said different pattern of signals for said forward and reverse rotational directions in response thereto.

48. An amusement machine as in claim 46 further comprising means responsive to said pattern of signals at each said sensor output during the rotation of its corresponding reel for determining the present rotational position of said corresponding reel relative to said corresponding fixed reference point.

49. An amusement machine comprising:

a plurality of reels coaxially mounted in a frame for independent rotation about an axis, each having a plurality of indicia thereabout;

a like plurality of sensors each positioned adjacent a corresponding one of said reels;

means responsive to manual user input for spinning said reels;

each said reel comprising a region of coded data circumferentially arranged about said axis;

each of said sensors cooperating with said coded data of its corresponding reel to output a pattern of signals marking the beginning and end of at least two arcuate portions of said reel during rotation thereof;

means responsive to each of said sensors for generating an acceleration signal if the duration of the first of said two equal arcuate portions of its corresponding reel is greater than the duration of the second such arcuate portion;

means for independently stopping the rotation of each said reel at a stopping position in response to the output of its corresponding sensor;

reel position determining means responsive to said sensor for determining the stopping position of each reel relative to a corresponding fixed reference point;

means responsive to the sequence of said stopping positions of said plurality of reels for assigning a predetermined game value thereto; and means responsive to said assigning means for providing a user perceivable indication of said assigned value.

50. An amusement machine as in claim 49 wherein said region of each said reel comprises a single track of said coded data positioned on a circumferential path about said axis at a fixed radial distance therefrom, and each said sensor is adapted to detect movement of its corresponding track past a single point at a fixed radial distance, and to output said pattern of signals in response thereto.

51. An amusement machine as in claim 49 further comprising means responsive to said pattern of signals at each said, sensor output during the rotation of its corresponding reel for determining the present rotational position of said corresponding reel relative to said corresponding fixed reference point.

52. An amusement machine as in claim 49 comprising means corresponding to each of said reels for generating a deceleration error signal if the duration of the first arcuate portion of its corresponding reel is less than the duration of the second such arcuate portion by more than a predetermined deceleration error amount.

53. An amusement machine as in claim 52 further comprising means responsive to said sensors for generating a slow speed error signal if the duration of at least one of said arcuate portions of a corresponding reel is greater than a predetermined minimum speed amount.

54. An amusement machine as in claim 52 further comprising means responsive to said sensors for generating a fast speed error signal if the duration of at least one of said arcuate portions of a corresponding reel is greater than a predetermined maximum speed amount.

55. An amusement machine comprising:

a plurality of reels coaxially mounted in a frame for independent rotation, each having a plurality of indicia thereabout;

a like plurality of sensors each positioned adjacent a corresponding one of said reels;

means responsive to manual user input for spinning said reels;

each said reel comprising a region of coded data circumferentially arranged about said axis;

each of said sensors cooperating with said coded data of its corresponding reel to output a pattern of signals marking the beginning and end of at least two equal arcuate portions of said reel during rotation thereof;

means responsive to each of said sensors for generating a deceleration error signal if the duration of the first of said two equal arcuate portions of its corresponding reel is less than the duration of the second such arcuate portion by more than a predetermined deceleration error amount;

means for independently stopping the rotation of each said reel at a stopping position in response to the output of its corresponding sensor;

reel position determining means responsive to said sensor for determining the stopping position of each of said reels relative to a corresponding fixed reference point;

means responsive to the sequence of said stopping positions of said plurality of reels for assigning a predetermined game value thereto; and means responsive to said assigning means for providing a user perceivable indication of said assigned value.

56. An amusement machine according to claim 55 wherein said region of each said reel comprises a single track of said coded data positioned on a circumferential path about said axis at a fixed radial distance therefrom, and each said sensor is adapted to detect movement of its corresponding track past a single point at a fixed radial distance, and to output said pattern of signals in response thereto.

57. An amusement machine as in claim 55 further comprising means responsive to said pattern of signals at each said sensor output during the rotation of its corresponding reel for determining the present rotational position of said corresponding reel relative to said corresponding fixed reference point.

58. An amusement machine comprising:

a plurality of reels coaxially mounted in a frame for independent rotation about an axis, each having a plurality of indicia thereabout;

a like plurality of sensors each positioned adjacent a corresponding one of said reels;

means responsive to manual user input for spinning said reels;

each said reel comprising a region of coded data circumferentially arranged about said axis;

each of said sensors cooperating with said coded data of its corresponding reel to output a pattern of signals marking the beginning and end of at least one predetermined arcuate portion of said reel;

means responsive to each said sensor during rotation of its corresponding reel for providing a slow speed error signal if the duration of said predetermined arcuate portion of said corresponding reel is greater than a predetermined minimum speed amount;

means for independently stopping the rotation of each said reel at a stopping position in response to the output of its corresponding sensor;

reel position determining means responsive to said sensor for determining the stopping position of said reel relative to a fixed reference point;

means responsive to the sequence of said stopping positions of said plurality of reels for assigning a predetermined game value thereto; and means responsive to said assigning means for providing a user perceivable indication of said assigned value.

59. An amusement machine according to claim 58 wherein said region of each said reel comprises a single track of said coded data positioned on a circumferential path about said axis at a fixed radial distance therefrom, and each said sensor is adapted to detect movement of its corresponding track past a single point at a fixed radial distance, and to output said pattern of signals in response thereto.

60. An amusement machine as in claim 58 further comprising means responsive to said pattern of signals at each said sensor output during the rotation of its corresponding reel for determining the present rotational position of said corresponding reel relative to said corresponding fixed reference point.

61. An amusement machine as in claim 58 further comprising means responsive to each said sensor during rotation of its corresponding reel for providing a fast speed error signal if the duration of said predetermined arcuate portion is less than a predetermined maximum speed amount.

62. An amusement machine comprising:

a reel mounted for independent rotation in a frame about an axis, having a plurality of indicia disposed thereabout;

a sensor positioned adjacent said reel;

means responsive to manual user input for spinning said reel;

said reel comprising a region of coded data circumferentially arranged about said axis;

said region comprising a plurality of fields corresponding to said plurality of said indicia, each field spanning a unique portion of said region and comprising a portion of said coded data corresponding to its respective indicium;

means for generating a random number;

means responsive to said sensor and to said random number generating means for counting an aggregate number of fields past said sensor after said reel spin starts as determined by said random number, without regard to the rotational position of said reel;

means responsive to said aggregate number counting means for issuing a stop reel signal when said aggregate number counting means has counted said random number;

means for stopping said reel at a stopping position in response to said stop reel signal; and reel position determining means responsive to said sensor for determining the stopping position of said reel relative to a fixed reference point.

63. An amusement machine according to claim 62, wherein said reel is defined as a primary reel, and further comprising:

a plurality of secondary reels, each having a corresponding sensor;

means responsive to said manual user input for spinning said secondary reels;

means for sequencing the stopping order for each of said primary and secondary reels in a predetermined sequence with said primary reel stopping first in said sequence;

means corresponding to each of said secondary reels for counting an aggregate number of fields past the sensor of its corresponding reel after the preceding reel of said predetermined sequence has been stopped;

means corresponding to each of said secondary reels for issuing a stop reel signal to its corresponding secondary reel when its corresponding aggregate number counting means has counted its corresponding aggregate number;

means corresponding to each of said secondary reels for stopping its corresponding reel at a stopping position in response to its corresponding stop reel signal;

said reel position determining means further comprising means responsive to the sensors of said secondary reels for determining the respective stopping position of each said secondary reel relative to a corresponding fixed reference point;

means responsive to the sequence of said stopping positions of said plurality of reels for assigning a predetermined game value thereto; and means responsive to said assigning means for providing a user perceivable indication of said assigned value.

64. An amusement machine according to claim 63 wherein said random number generating means further comprises means for generating a plurality of secondary random numbers, each corresponding to one of said secondary reels, and each of said secondary stop reel signal issuing means issues its stop reel signal when its corresponding aggregate counting means has counted said corresponding secondary random number.

65. An amusement machine according to claim 64 wherein said random number generating means comprises means for generating said primary random number from a sequence of numbers having a predetermined lower limit, and means for generating each of said secondary random numbers from a sequence of numbers having an upper limit less than said primary random number lower limit.

66. An amusement machine according to claim 63, wherein said reel position determining means comprises:

means responsive to each said sensor for detecting passage of a home field of its corresponding reel; and reel position counting means for counting the number of fields that pass each said sensor after said home field passage is detected.

67. An amusement machine according to claim 62, wherein said reel position determining means comprises:

means responsive to said sensor for detecting passage of a home field of said reel; and reel position counting means for counting the number of fields that pass said sensor after said home field passage is detected.

68. An amusement machine comprising:

a reel mounted in a frame for rotation about an axis, having a plurality of indicia disposed thereabout;

said reel comprising a single track positioned on a circumferential path about said axis, for monitoring the rotational position of the reel relative to a fixed reference point;

said track comprising a plurality of fields corresponding to said plurality of said indicia, each field spanning a unique arcuate path at a fixed radial distance from said axis;

a sensor positioned so as to detect movement of said fields past a single point at a fixed radial distance, said sensor cooperating with said track to output a pattern of high and low signals as said track rotates;

at least a portion of said track comprising a continuous array of said fields, each having one high and one low state of different arcuate spans and said two states in each field of said array being arranged in either a first or a second order, with respect to the movement of said reel in a given rotational direction, said first order defined by a field having the shorter of its two states preceding the longer one, and said second order defined by a field having the longer of its two states preceding the shorter one;

the sequence of said fields in said array alternating between said first order fields and said second order fields;

means responsive to said sensor output for determining the rotational position of said track relative to said field reference point.

69. An amusement machine as in claim 68 wherein said array comprises all but one of said plurality of fields of said track, said one remaining field having one high and one low state of different arcuate spans, and the sequence of said longer-and shorter span states of said remaining field is the same as the sequence of at least one of its adjoining fields.

70. An amusement machine according to claim 68 wherein the ratio of state span lengths in each field of said array is the same.

71. An amusement machine as in claim 68 further comprising means responsive to said sensor for generating a rotational direction error signal in response to a predetermined one of a forward and reverse reel rotational direction.

72. An amusement machine as in claim 68 further comprising:

means responsive to said sensor for comparing the durations of two equal arcuate portions of said array as said reel rotates and generating an acceleration error signal if the duration of the first such arcuate portion is greater than the duration of the second such arcuate portion by more than a predetermined acceleration error amount.

73. An amusement machine according to claim 72 wherein each of said arcuate portions comprises one of said fields.

74. An amusement machine as in claim 68 further comprising:

means responsive to said sensor for comparing the durations of two equal arcuate portions of said array as said reel rotates and generating a deceleration error signal if the duration of the first such arcuate portion is less than the duration of the second such arcuate portion by more than a predetermined deceleration error amount.

75. An amusement machine according to claim 74 wherein each of said arcuate portions comprises one of said fields.

76. An amusement machine as in claim 68 further comprising means responsive to said sensor for generating a slow speed error signal if the duration of a predetermined arcuate portion of said array is greater than a predetermined minimum speed amount.

77. An amusement machine according to claim 76 wherein said predetermined arcuate portion comprises one of said fields.

78. An amusement machine as in claim 76 further comprising means responsive to said sensor for generating a fast speed error signal if the duration of said predetermined arcuate portion of said track is less than a predetermined maximum speed amount.

79. An amusement machine according to claim 68 wherein said track comprises at least two equal arcuate portions, and further comprising:

means responsive to said sensor as said reel rotates for generating a rotational direction error signal in response to predetermined one of a forward and reverse reel rotational direction;

means responsive to said sensor for generating an acceleration error signal if the duration of the first of said two equal arcuate portions as said reel rotates is greater than the duration of the second such arcuate portion;

means responsive to said sensor for generating a deceleration error signal if the duration of the first of said two equal arcuate portions as said reel rotates is less than the duration of the second such arcuate portion by more than a predetermined deceleration error amount;

means responsive to said sensor for generating a slow speed error signal if the duration of at least one of said arcuate portions as said reel rotates is greater than a predetermined minimum speed amount; and means responsive to said sensor for generating a fast error signal if the duration of at least one of said arcuate portions as said reel rotates is less than a predetermined maximum speed amount.

* * * * *